US005538288A

United States Patent [19]

Heath

[11] Patent Number: 5,538,288

[45] Date of Patent: Jul. 23, 1996

[54] PARALLELOGRAM SHEET FOR FORMING A REVERSIBLE PARALLELEPIPED

[76] Inventor: Mark P. Heath, 1401 Lydia Dr., Lafayette, Colo. 80026

[21] Appl. No.: 471,831

[22] Filed: Jun. 7, 1995

[51] Int. Cl.[6] ..... B42D 5/04

[52] U.S. Cl. ..... 283/2; 283/4; 40/107

[58] Field of Search ..... 283/2–4, 34, 35, 283/117; 40/107, 335

[56] References Cited

U.S. PATENT DOCUMENTS

| | | | |
|---|---|---|---|
| 3,150,812 | 9/1976 | Sabol . | |
| 3,190,532 | 9/1977 | Marsh . | |
| 3,332,602 | 5/1989 | Flax . | |
| 3,826,029 | 6/1974 | Lieberman . | |
| 3,853,741 | 12/1990 | Klupt . | |
| 4,409,750 | 5/1992 | Silbermintz . | |
| 4,648,548 | 6/1992 | Shin . | |
| 5,222,657 | 6/1993 | Holland, Jr. . | |
| 5,329,711 | 7/1994 | Dewey | 283/2 X |

*Primary Examiner*—Willmon Fridie, Jr.
*Attorney, Agent, or Firm*—Donald W. Margolis; Emery L. Tracy

[57] ABSTRACT

A substantially rigid, segmented, flat sheet blank parallelogram, which, may be shaped and folded into a reversible three dimensional rectangular parallelepiped. The sheet includes six foldably connected side wall panels, each in the form of a parallelogram, preferably a square or rectangle. The sheet also includes additional material such as support panels, and/or border material which defines, with the six side wall panels, the sheet blank in the shape of a parallelogram of the present invention. In preferred embodiments the flat sheet blank parallelogram is rectangular in shape. In some embodiments there is no excess border material, while in still other preferred embodiments there are no support panels. In some embodiments the first display surfaces of the six side wall panels and the second display surfaces of the six side wall panels both carry indicia, preferably the six side wall panel first display surfaces each carry one of six consecutive calendar months and the six wall panel second display surfaces each carry one of the remaining six consecutive calendar months of a calendar year on its respective second display surface. The unfolded sheet may be sized to be mailable without an envelope. The sheet may be made of paper, poster sheet material, fiber sheet, card sheet, cardboard, and foldable plastic.

22 Claims, 11 Drawing Sheets

PARALLELOGRAM SHEET FOR FORMING A REVERSIBLE PARALLELEPIPED

BACKGROUND OF THE INVENTION

1. Field of the Invention

The present invention relates to a rigid, segmented, flat sheet blank having a first and a second side which has utility in being folded into a reversible three dimensional rectangular parallelepiped display assembly. In particular, it relates to such a sheet blank which is initially in the shape of a parallelogram, which, when in its initial unfolded form, may be mailable without an envelope. It may also be used, without mailing, as a card, poster or any other form of flat sheet carrying printed indicia on the first and second sides of the card, such as a calendar display of six months on the first side and six months on the second side. When carrying such a calendar display and folded to form a rectangular parallelepiped it displays six months of the calendar, and when unfolded and refolded to form a reverse rectangular parallelepiped it displays the other six months of the calendar.

2. Discussion of the Prior Art

In the past, there have been attempts to create and market a folding calendar/display system, i.e., a calendar display board capable of being folded into various shapes. To date, the display boards are generally made of relatively stiff material. While displaying limited calendar and advertisement data, the display boards, if foldable into a polygon, were not of a size or shape which allowed them to be mailed without an envelope.

For example, Lieberman U.S. Pat. No. 3,826,029 describes a calendar arrangement comprising a flexible coil of panels, each panel secured by up to two adjacent panels, initially in the form of a cube, having calendar days and dates on one side and a pictorial image on the other side. The flexible coil includes an adhesive applied on selected panels thereof which allows the calendar arrangement to be adhered to a wall or other flat surface. When unfolded it is not capable of being mailed by itself due to its size and the limited securement between the panels. Furthermore, calendar data is displayed on only one side of the coil, and only when the calendar arrangement is unfolded.

None of the known prior art provides a flat sheet blank in the form of a parallelogram which has a first and a second surface, each surface carrying different indicia, which flat sheet blank may be folded into a three dimensional geometric display system. Furthermore, none of the known prior art provides such a sheet blank which may be distributed or mailed without an envelope, for example as a postcard, or used as a card, poster or any other form of flat sheet carrying printed indicia on the first and second sides of the card, such as a calendar display of six months on the first side and six months on the second side. They do not teach such a sheet blank which may be folded to display a first set of indicia, and then opened and refolded in the reverse direction to display a second set of indicia, for example, wherein the first set of indicia displays six months and days and dates of a calendar, and which, when opened, and refolded in the reverse direction displays the next six months and days and dates of a calendar.

SUMMARY OF THE INVENTION

It is therefore an object of the present invention to provide a flat sheet blank having a first and a second surface, each surface carrying different indicia.

It is a further object of the present invention to provide such a flat sheet blank which may be folded into a three dimensional geometric display system.

It is a further object of the present invention to provide such a sheet blank which may be distributed or mailed without an envelope, for example as a postcard.

It is a further object of the present invention to provide such a sheet blank which may be folded to display a first set of indicia, and then opened and refolded in the reverse direction to display a second set of indicia.

It is a further object of the present invention wherein the first set of indicia displays six months and days and dates of a calendar, and which, when opened, and refolded in the reverse direction displays the next six months and days and dates of a calendar.

The present invention relates to a substantially rigid, segmented, flat sheet blank which, as detailed below, may be shaped and folded into a reversible three dimensional rectangular parallelepiped. The rigid, segmented, flat sheet blank is initially in the shape of a parallelogram, preferably a rectangle. The sheet includes, at a minimum, six foldably connected side wall panels, with each side wall panel being in the form of a parallelogram, preferably a square or rectangle. Each parallelogram is of a given size and shape. Four of the side wall panels are aligned in series along a common axis and define a pair of side edges offset from the common axis. A pair of side wall panels are offset from the linear series of four side wall panels, one side wall panel offset on each side edge. Each offset side wall panel is foldably connected to one and only one of the side wall panels of the series of four side wall panels. Each of the six side wall panels is a parallelogram of a given size and shape and has at least one matching side wall panel parallelogram of the same size and shape separated from it by at least one intervening side wall panel. Furthermore, the pair of offset side wall panel parallelograms each have substantially the same size and shape.

In addition to the six side wall panels, the segmented, flat sheet blank includes additional material which defines, with the six side wall panels, a parallelogram. The additional material may include one or more support panels, or border material, and combinations of support panels and excess border material. Each support panel, if any, is foldably connected to one and only one side wall panels. The excess border material is removably connected to the side wall panels, and/or to the support panels, if any. The combined six foldably connected side wall panels, the support panels, if any, and excess border material, if any, together define the rigid, substantially flat, segmented sheet blank in the shape of a parallelogram of the present invention. In preferred embodiments the flat sheet blank parallelogram is rectangular in shape.

The rigid, substantially flat, segmented sheet blank of the present invention has a first side having a first display surface, and a second opposed side having a second display surface. As detailed below, after the excess border material, if any, is removed from the sheet, the six side wall panels and any support panels of the sheet are then capable of being folded into a first three dimensional rectangular parallelepiped in which the first display surface is on the exterior. Subsequently, if desired, the first three dimensional rectangular parallelepiped may then be unfolded and refolded into a second three dimensional rectangular parallelepiped in which the second display surface is on the exterior of the parallelepiped. In preferred embodiments the rectangular parallelepiped is in the form of a cube, although other shapes of parallelepiped may be formed.

In one preferred embodiment there is excess border material and six support panels. In this embodiment three support panels are offset on each side edge of the linear series of four side wall panels, with each offset support panel being foldably connected to only one of the side wall panels at the locations at which there are no offset side wall panels connected to the series of four side wall panels. In one form of this embodiment there is one or more tab carried by the side wall panels. The resulting flat sheet blank in the shape of a parallelogram is formed from the excess border material, the six side wall panels, the tabs and the six support panels.

In other preferred embodiments there is no excess border material, while in still other preferred embodiments there are no support panels, all as detailed below.

In some embodiments the first display Surfaces of the six side wall panels and the second display surfaces of the six side wall panels both carry indicia. In preferred embodiments each of the six side wall panel first display surfaces carry one calendar month of six consecutive months of a calendar year, and each of the six side wall panel second display surfaces carry one of the remaining six consecutive calendar months of a calendar year. Again, preferably, each calendar month includes days and dates. As a result, the sheet blank may be folded to display six consecutive months of a calendar year, and then opened and refolded in the reverse direction to display the remaining six months of a calendar year.

While the use of tabs has been described to close and maintain the cubic parallelepiped shape of the folding display assembly, it will be appreciated that any type of fastening mechanism for use in securing together the display system is within the scope of the present invention and could include, any other equivalent appropriate art known fastening means, including for example, but not limited to adhesive, adhesive tabs, hook and loop fasteners, snaps or the like.

In all embodiments of the present invention, the sheet of the present invention may be sized and shaped such that the resultant display has various geometric shapes. The side walls may receive, in addition to calendar information, other visual indicia, such as trademarks, service marks, logos, trade names, slogans, advertisements and the like. Also, the present invention is unique in that the unfolded sheet may be sized to conform to U.S. Postal Service regulations to be mailable as a postcard, or, if outside of that size range, to be mailable as an open flat 1st class piece without an envelope with an appropriate amount of postage. It may also be used, without mailing, as a card, poster or any other form of flat printed material.

The rigid flat sheet blank of the present invention may be made of paper, poster sheet material, fiber sheet, card sheet, cardboard, and foldable plastic. The thickness of such sheet material is a matter of choice, so long as the required functions may be achieved.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1A:
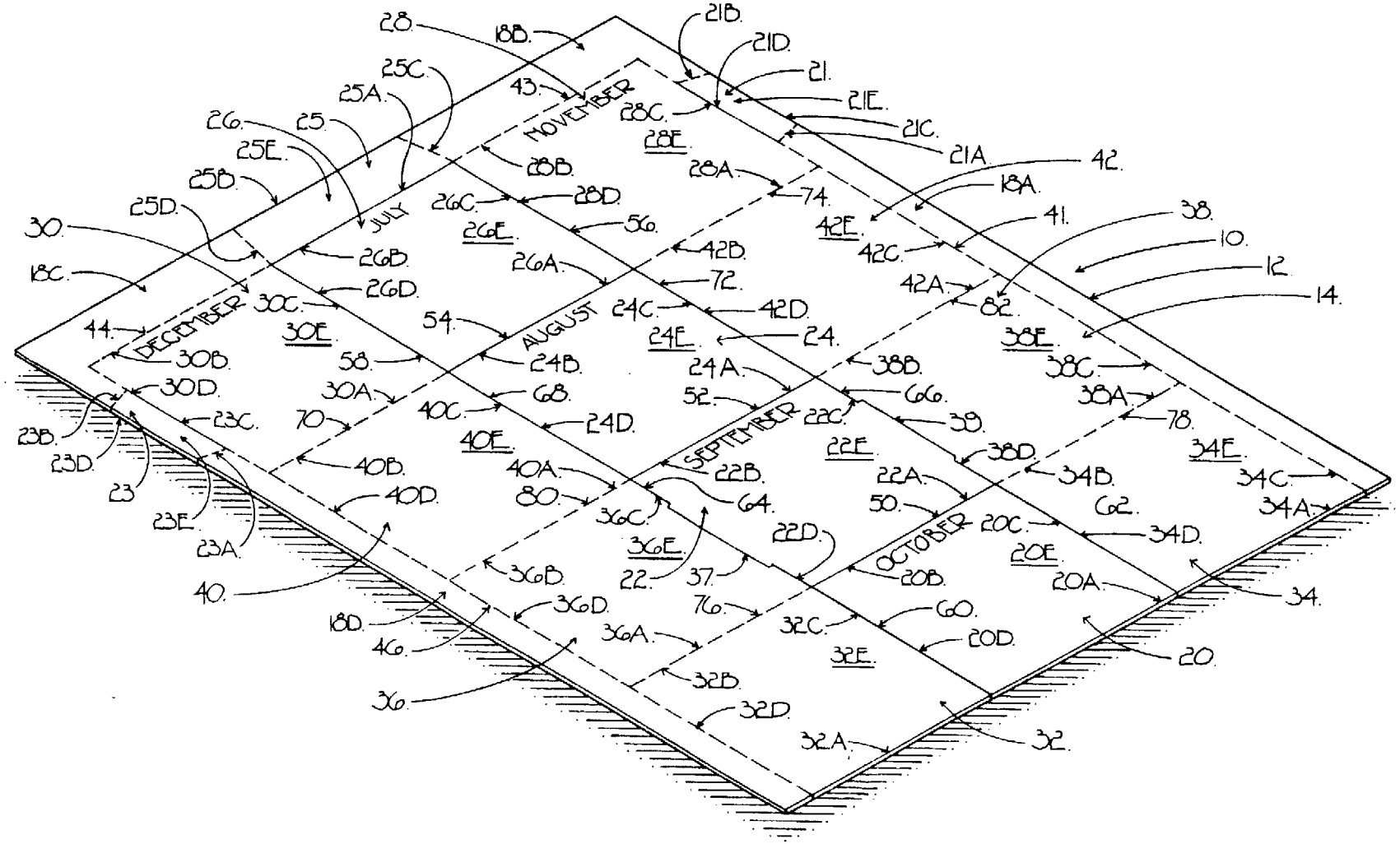
FIG. 1*a* is an isometric view of one side of one embodiment of a flat sheet blank of the present invention prior to the removal of excess border materials and folding it into a reversible three dimensional rectangular parallelepiped display calendar assembly.
Figure 1B:
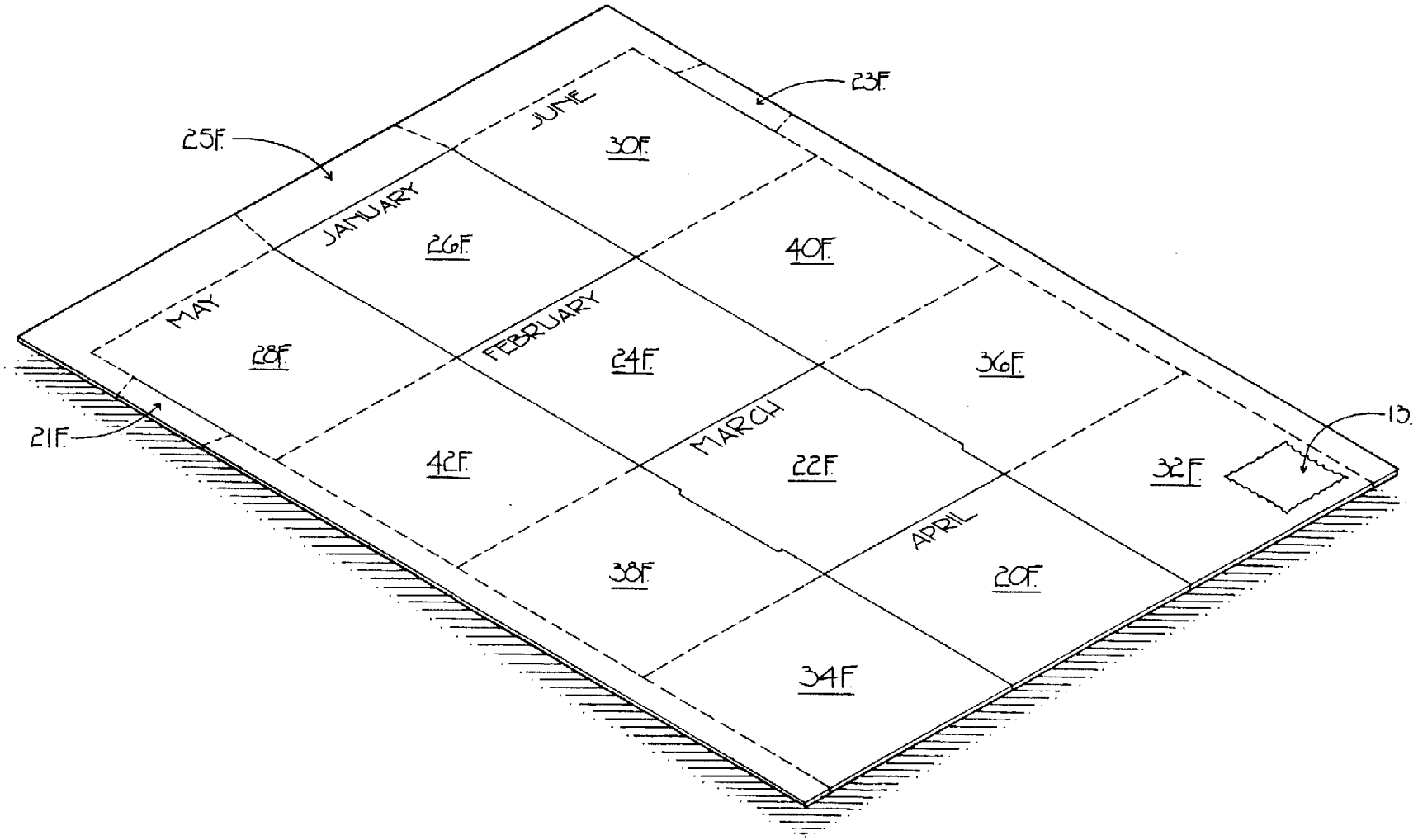
FIG. 1*b* is an isometric view of the reverse or second side of the flat sheet blank of FIG. 1*a* prior to the removal of excess border materials and folding it into a reversible three dimensional rectangular parallelepiped display calendar assembly, and illustrating placement of postage for use of the system when mailing and prior to the removal of excess border materials and folding it into a reversible three dimensional rectangular parallelepiped display calendar assembly.

As illustrated in an isometric view in FIGS. 1*a* and 1*b* is a flat sheet blank of the present invention, indicated generally at 10, prior to the removal of excess border materials and folding it into a reversible three dimensional geometric cubic parallelepiped. In the preferred embodiment which is shown the sheet blank may be folded to display six months and days and dates of a calendar arrangement, or the like, and then opened and refolded in the reverse direction to display the other six months and days and dates of a calendar arrangement, or the like. The display system 10 includes a flat display sheet blank 12. The display sheet blank 12 is preferably a parallelogram, and sized such that postage may be affixed thereto for the display sheet blank 12 to be mailable as a postcard or open flat mail piece, or the like, without an envelope. The display sheet blank 12 includes a first display side 14 and a second display side 16 opposite the first display side 14, as illustrated in FIG. 1*b*. In the embodiment in which display sheet blank 12 is intended to have utility as a mailable postcard, the second display side 16 preferably includes, in addition to calendar information, mailing instructions, including the receiver's address, a location to receive required postage and other indicia, such as advertising. The first display side 14 may include calendar information and perhaps assembly instructions, as well as advertising or other indicia. The process of folding of the calendar display system 10 of the present invention is described in greater detail below.

Referring again to FIG. 1*a*, a first preferred embodiment of the flat display sheet blank 12 of the present invention, which is foldable into a reversible three dimensional rectangular parallelepiped display system is illustrated. Flat display sheet blank 12 is rectangular and includes excess material in the form of a plurality of removable border materials 18A, 18B, 18C and 18D to define its initial rectangular form. Flat display sheet blank 12 includes six side wall panels 20, 22, 24, 26, 28 and 30 and six support panels 32, 34, 36, 38, 40 and 42. Flat display sheet blank 12 also includes three tab portions 21, 23 and 25 which are exposed after border materials 18A, 18B, 18C and 18D have been removed. In the preferred embodiment which is illustrated in FIG. 1, each side wall 20, 22, 24, 26, 28 and 30 includes a calendar month displayed thereon such that when display sheet blank 12 is folded into the form of a cubic rectangular parallelepiped, the display system 12 displays a different single month on each of the six sides of the cubic rectangular parallelepiped. In a preferred embodiment wherein the display system 10 includes six side wall panels, the first side 14 and the second side each include six months such that the entire year may be displayed by the display system 10, as explained below.

The display sheet blank 12 includes a perimeter defined by the outer edges of border materials 18A, 18B, 18C and 18D, the outer edges of side wall panel 20 and support panels 32 and 34 and the outer edges of tab portions 21, 23, 25. In preferred embodiments, the perimeter of display sheet blank 12 has dimensions which allow it to be mailable as a 1st class postcard via the U.S. Postal Service, although other sizes are mailable with or without an envelope using the required amount of postage 13.

The entire display sheet blank 12 is assembled from a single piece of rigid sheet or foldable material, thereby reducing waste by eliminating the need for additional material. Display sheet blank 12 may be produced from material such as, but not limited to paper, poster sheet material, fiber sheet, card sheet, cardboard, foldable plastic and the like. The thickness of such sheet material is a matter of choice, so long as the required functions may be achieved.

In the first embodiment, each of the side wall panels 20, 22, 24, 26, 28 and 30 are substantially square in shape as illustrated in FIG. 1*a*. The side wall panel 20 includes a plurality of side wall edges 20A, 20B, 20C and 20D and a first side face 20E. The side wall panel 20 also includes a second side face 20F as is illustrated in FIG. 1*b*. Referring to FIG. 1*a*, the panel edge 20A is substantially opposite and parallel to the panel edge 20B and the panel edge 20C is substantially opposite and parallel to the panel edge 20D.

Similarly, the side wall panel 22 includes a plurality of side wall edges 22A, 22B, 22C and 22D and a first side face 22E. The side wall panel 22 also includes a second side face 22F as is illustrated in FIG. 1*b*. As shown in FIG. 1*a*, the panel edge 22A is substantially opposite and parallel to the panel edge 22B and the panel edge 22C is substantially opposite and parallel to the panel edge 22D.

Side wall panel 24 includes a plurality of side wall edges 24A, 24B, 24C and 24D and a first side face 24E. The side wall panel 24 also includes a second side face 24F as is illustrated in FIG. 1*b*. As shown in FIG. 1*a*, the panel edge 24A is substantially opposite and parallel to the panel edge 24B and the panel edge 24C is substantially opposite and parallel to the panel edge 24D.

Side wall panel 26 includes a plurality of side wall edges 26A, 26B, 26C and 26D and a first side face 26E. The side wall panel 26 also includes a second side face 26F in FIG. 1*a*. The panel edge 26A is substantially opposite and parallel to the panel edge 26B and the panel edge 26C is substantially opposite and parallel to the panel edge 26D.

Side wall panel 28 includes a plurality of side wall edges 28A, 28B, 28C and 28D and a first side face 28E. The side wall panel 28 also includes a second side face 28F in FIG. 1*b*. The panel edge 28A is substantially opposite and parallel to the panel edge 28B and the panel edge 28C is substantially opposite and parallel to the panel edge 28D.

Side wall panel 30 includes a plurality of side wall edges 30A, 30B, 30C and 30D and a first side face 30E. The side wall panel 30 also includes a second side face 30F, as shown in FIG. 1*b*. Referring to FIG. 1*a*, the panel edge 30A is substantially opposite and parallel to the panel edge 30B and the panel edge 30C is substantially opposite and parallel to the panel edge 30D.

Since the six side panels 20, 22, 24, 26, 28 and 30 are square, it follows that each of the side edges 20A, 20B, 20C, 20D, 22A, 22B, 22C, 22D, 24A, 24B, 24C, 24D, 26A, 26B, 26C, 26D, 28A, 28B, 28C, 28D, 30A, 30B, 30C and 30D are all substantially of equal length. However, it should be noted that side panels which are not square, as detailed below, are within the teaching of the present invention.

The support panels 32, 34, 36, 38, 40 and 42 in the first embodiment are also substantially square in shape. The support panel 32 has a plurality of support panel edges 32A, 32B, 32C and 32D and a first side face 32E. The support panel 32 also includes a second side face 32F as is illustrated in FIG. 1*b*. The support panel 34 has a plurality of support panel edges 34A, 34B, 34C and 34D and a first side face 34E. The support panel 34 also includes a second side face 34F as is illustrated in FIG. 1*b*. The support panel 36 has a plurality of support panel edges 36A, 36B, 36C and 36D and a first side face 36E. The support panel 36 also includes a second side face 36F as is illustrated in FIG. 1*b* The support panel 38 has a plurality of support panel edges 38A, 38B, 38C and 38D and a first side face 38E. The support panel 38 also includes a second side face 38F as is illustrated in FIG. 1*b*. The support panel 40 has a plurality of support panel edges 40A, 40B, 40C and 40D and a first side face 40E. The support panel 40 also includes a second side face 40F as is illustrated in FIG. 1*b*. The support panel 42 has a plurality of support panel edges 42A, 42B, 42C and 42D and a first side face 42E. The support panel 42 also includes a second side face 42F as is illustrated in FIG. 1*b*.

Since the six support panels 32, 34, 36, 38 and 40, 42 are preferably square, it follows that each of the side edges 32A, 32B, 32C, 32D, 34A, 34B, 34C, 34D, 36A, 36B, 36C, 36D, 38A, 38B, 38C, 38D, 40A, 40B, 40C, 40D, 42A, 42B, 42C and 42D are all of equal length. As detailed below, support panels which are not substantially square are within the teaching of the present invention.

Preferably, the tab portions 21, 23 and 25 are foldably connected to the corresponding adjacent side wall panels. The tab portion 21 includes a plurality of tab edges 21A, 21B, 21C and 21D and a first side face 21E. The tab portion 21 also includes a second side face 21F as is illustrated in FIG. 1*b*. Referring to FIG. 1*a*, the tab edge 21A is substantially opposite to the tab edge 21B and the tab edge 21C is substantially opposite and parallel to the tab edge 21D. The tab edges 21A and 21B are at substantial acute angles to the tab edge 21D and are additionally angled toward each other to allow easier assemblage of the folding calendar display system 10 of the present invention as described further below.

The tab portion 23 includes a plurality of tab edges 23A, 23B, 23C and 23D and a first side face 23E. The tab portion 23 also includes a second side face 23F as is illustrated in FIG. 1*b*. Referring to FIG. 1*a*, the tab edge 23A is substantially opposite to the tab edge 23B and the tab edge 23C is substantially opposite and parallel to the tab edge 23D. The tab edges 23A and 23B are at substantial acute angles to the tab edge 23C and are additionally angled toward each other.

The tab portion 25 includes a plurality of tab edges 25A, 25B, 25C and 25D and a first side face 25E. The tab portion 25 also includes a second side face 25F as is illustrated in FIG. 1*b*. Referring to FIG. 1*a*, the tab edge 25A is substantially opposite and parallel to the tab edge 25B and the tab edge 25C is substantially opposite to the tab edge 25D. The tab edges 25C and 25D are at substantial acute angles to the tab edge 23A and are additionally angled toward each other.

The border materials 18A, 18B, 18C and 18D is positioned substantially around and removably connected by a score line 46 to the tab portion 23 and side wall panels 30 and support panels 32, 36 and 40, by a score line 43 to the side wall panel 28, and tabs 21 and 25 and by a score line 44 to side wall panel 30, and tabs 23 and 25, by a score line 41 to tab 21 and side wall panel 28 and ,support panels 34, 38 and 42. The score lines 41, 43, 44, 46 provide for easy removal of the border material 18 to begin the folding process to transform the folding calendar system 10 of the present invention from a rectangular configuration, such as that of a mailable postcard.

The side wall panels are foldably connected to each adjacent side wall panel. First, the panel 20 is foldably connected to the panel 22 along the panel edge 20B and the panel edge 22A forming a fold line 50. Second, the panel 22 is foldably connected to the panel 24 along the panel edge 22B and the panel edge 24A forming a fold line 52. Third, the panel 24 is foldably connected to the panel 26 along the panel edge 24B and the panel edge 26A forming a fold line 54. Fourth, the panel 26 is foldably connected to the panel 28 along the panel edge 26C and the panel edge 28D forming a fold line 56. Finally, the panel 26 is also foldably connected to the panel 30 along the panel edge 26D and the panel edge 30C forming a fold line 58.

In addition to connecting the side wall panels as detailed above, the support panels are preferably foldably connected to the corresponding adjacent side wall panels in a similar fashion. First, the support panel 32 is foldably connected to the side panel 20 along the panel edge 32C and the panel edge 20D forming a fold line 60. Second, the support panel 34 is foldably connected to the side panel 20 along the panel edge 34D and the panel edge 20C forming a fold line 62. Third, the support panel 36 is foldably connected to the side panel 22 along the panel edge 36C and the panel edge 22D forming a fold line 64. A slot 37 is formed along the fold line 64 for receiving the tab 23 as will be discussed further below. Fourth, the support panel 38 is foldably connected to the side panel 22 along the panel edge 38D and the panel edge 22C forming a fold line 66. A slot 39 is formed along the fold line 66 for receiving the tab 21 as will be discussed further below. Fifth, the support panel 40 is foldably connected to the side panel 24 along the panel edge 40C and the panel edge 24D forming a fold line 68. Sixth, the support panel 42 is foldably connected to the side panel 24 along the panel edge 42D and the panel edge 24C forming a fold line 72.

Furthermore, the support panels are also removably connected to each corresponding adjacent support panel by score lines. As used herein, the term "score lines" refers to any mechanism, whether scored, perforated, incised, or in any other manner providing a zone of weakness which allows for convenient cutting, tearing or separation during the appropriate step in assembly. First, the support panel 32 is connected to the support panel 36 along the panel edge 32B and the panel edge 36A forming a score line 76. Second, the support panel 34 is connected to the support panel 38 along the panel edge 34B and the panel edge 38A forming a score line 78. Third, the support panel 36 is connected to the support panel 40 along the panel edge 36B and the panel edge 40A forming a score line 80. Fourth, the support panel 40 is also connected to the side panel 30 along the panel edge 40B and the panel edge 30A forming a score line 70. Fifth, the support panel 42 is connected to the side panel 28 by a score line along the panel edge 42B and the panel edge 28A forming a score line 74. Finally, the support panel 38 is connected to the support panel 42 along the panel edge 38B and the panel edge 42A forming a score line 82.

Figure 2:
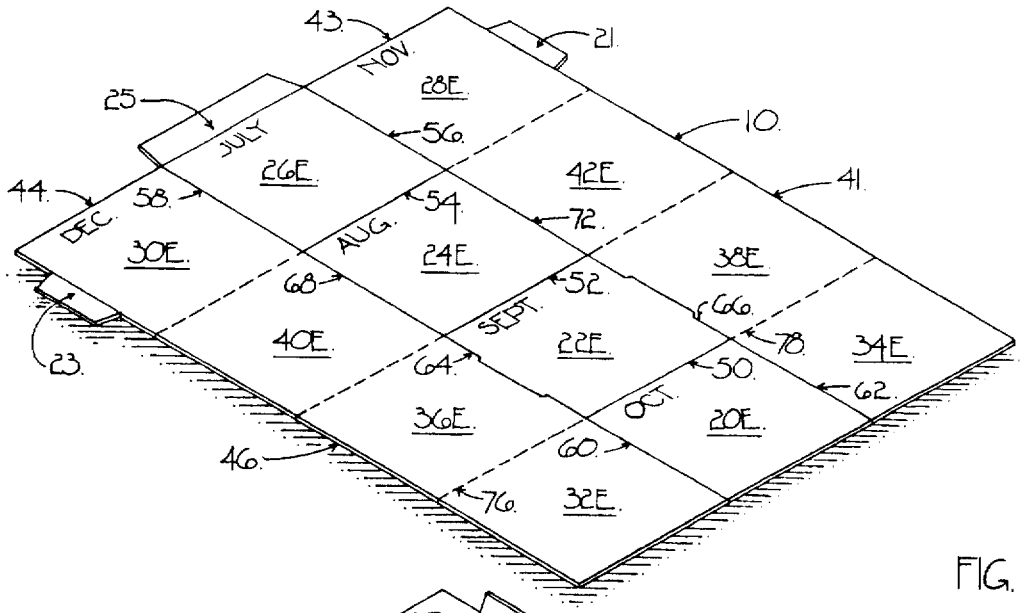
FIG. 2 is an isometric view illustrating the flat sheet blank which is provided after the removal of excess border materials from the sheet blank of FIG. 1*a* to reveal tabs.

As illustrated in FIG. 2, to form the folding calendar display system 10 according to the first embodiment of the present invention, the border materials 18A, 18B, 18C and 18D, which are removably connected about the display sheet blank 12 as described above, is separated from the side wall panels and the tab portions along the score lines 41, 43, 44, 46 between the border materials and the various tab portions, side panels and support panels. Once disconnected, the border materials 18A, 18B, 18C and 18D is discarded or recycled.

Figure 3:
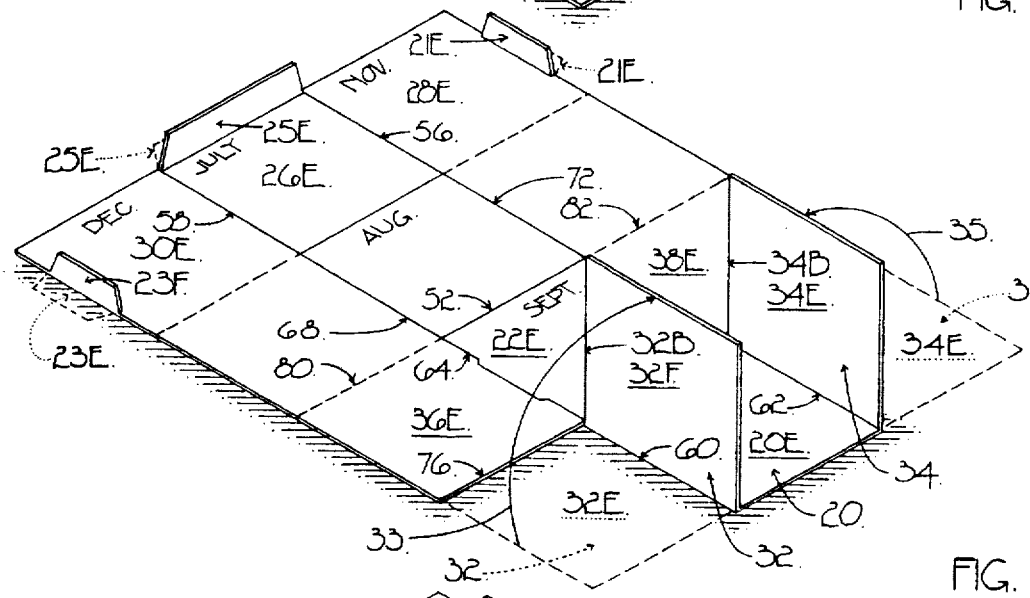
FIG. 3 is an isometric view illustrating the folding of the tabs and a subsequent folding step of the blank sheet blank of FIG. 2.

As illustrated in FIG. 3, the tab portions 21, 23 and 25 are folded upwardly toward the first side face 28E, 30E and 26E of side wall panels 28, 30 and 26, respectively, until the tabs 21, 23, 25 are at an angle of approximately 90 degrees to the side wall panels 26, 28, 30. Then, the connection along the score line 76 between support panels 32 and 36, along the score line 78 between support panels 34 and 38, along the score line 80 between support panels 36 and 40, along the score line 82 between support panels 38 and 42, along the score line 70 between support panel 40 and side wall panel 30 and along the score line 74 between support panel 42 and side wall panel 28 are all disconnected. Next, the support panels 32 and 34 are folded upwardly and inwardly, as shown by arrows 33 and 35, respectively, toward the first side face 20E of the side wall panel 20 along the fold lines 60 and 62, respectively.

Figure 4:
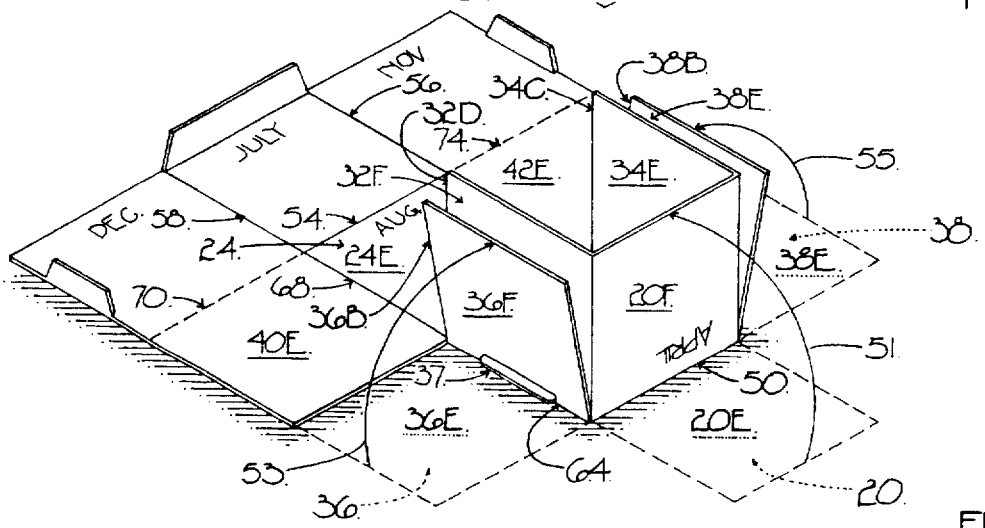
FIG. 4 is an isometric view illustrating yet another subsequent folding step of the blank sheet blank of FIG. 2.

After the end panels 32 and 34 have been folded upwardly, then, as illustrated in FIG. 4, the side wall panel 20 is folded upwardly, as shown by arrow 51, along the fold line 50, until (the following are not visible in FIG. 4, but see FIG. 3) the support panel edges 32B and 34B rest against the first side face 22E of the side wall panel 22. Next, the support panels 36 and 38 are folded upwardly, as shown by arrows 53 and 55, along the fold lines 64 and 66 (not visible in FIG. 4, but see FIG. 3), respectively, until the first side face 36E and 38E of the support panels 36 and 38, respectively, rest against the second side face 32F and 34F (if not visible in FIG. 4, see FIG. 1*b*), of the support panels 32 and 34, respectively. Folding of the support panels 36 and 38 further open the slots 37 and 39 for receiving the tabs 21 and 23 as will be described below.

Figure 5:
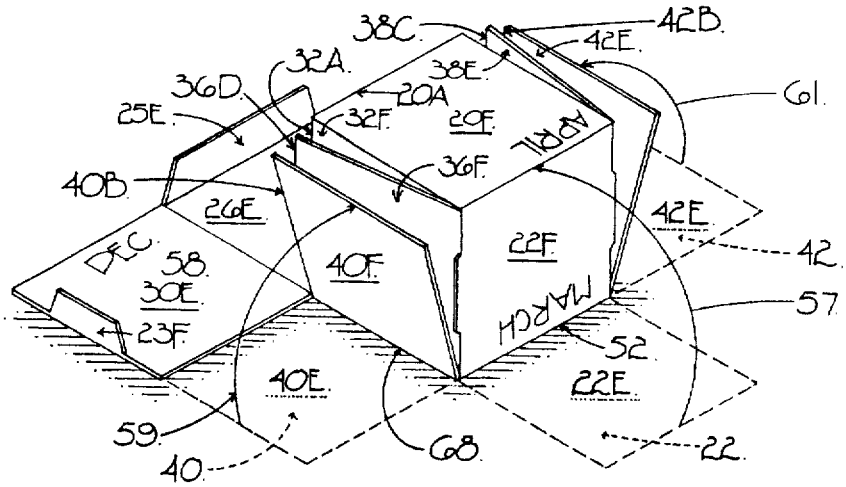
FIG. 5 is an isometric view illustrating a further subsequent folding step of the blank sheet of FIG. 2.

As illustrated in FIG. 5, the side wall panel 22 is then folded upwardly, as shown by arrow 57, along the fold line 52 (the following are not visible in FIG. 5, but see FIG. 4) until the panel edges 32D, 34D, 36B and 38B rest against the first side face 24E of the side wall panel 24. Then, the support panels 40 and 42 are folded upwardly, as shown by arrows 59 and 61, along the fold lines 68 and 72 (not visible in FIG. 5, but see FIG. 3), respectively, until the first side face 40E, 42E of support panels 40, 42 rest against the second side face 36F, 38F (if not visible in FIG. 5, see FIG. 1*b*), of the support panels 36, 38, respectively.

Figure 6A:
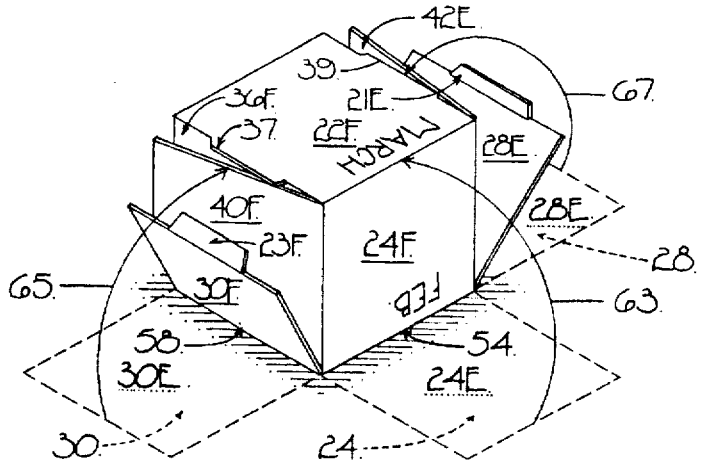
FIG. 6*a* is an isometric view of the first embodiment of the present invention illustrating a final folding step of the blank sheet of FIG. 2 to form it into a completed reversible three dimensional geometric cubic parallelepiped display calendar assembly.
Figure 6B:
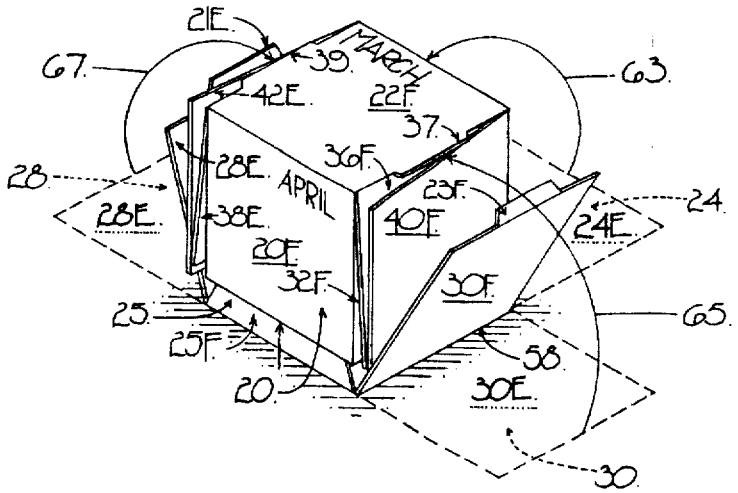
FIG. 6*b* is a rotated isometric view of FIG. 6*a*, illustrating another view of the final folding step of the blank sheet of FIG. 2 to form it into a completed reversible three dimensional geometric cubic parallelepiped display calendar assembly.

As illustrated in FIG. 6*a*, the side wall panel 24 is then folded upwardly, as shown by arrow 63, along the fold line 54 until (the following are not visible in FIG. 6, but see FIGS. 5 and 6*b*) the panel edges 20A, 32A, 34A, 36D, 38C, 40B and 42B rest against the first side face 26E of the side wall panel 26. Finally, the side wall panels 28 and 30 are folded upwardly, as shown by arrows 65 and 67, at fold lines 56 and 58 (not visible in FIG. 6, but see FIGS. 2–4), until the first side face 28E, 30E, of the side wall panels 28, 30, respectively, rest against the second side face 42E and 40F (if not visible in FIG. 6*a*, see FIGS. 1*b* and 6*b*) of the support panels 42 and 40, respectively. As the side wall panels 28, 30 are folded upwardly, the tab portions 21 and 23 are guided into slots 39 and 37, respectively. Furthermore, as illustrated in FIG. 6*b*, the tab 25 is guided under the side wall panel 20 until the second side face 25F of the tab portion 25 rests against the first side face 20E of the side wall panel 20. Together, the tab portions 21, 23 and 25, and the slots 37 and 39 complete and then maintain the cubic parallelepiped shape of the folding display assembly of the first embodiment of the present invention.

Figure 7A:
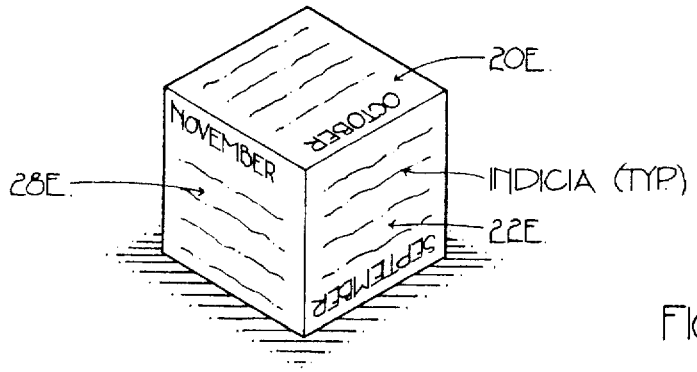
FIGS. 7*a* and 7*b* are two isometric views of the completed first embodiment of the reversible three dimensional geometric cubic parallelepiped assembly of the present invention displaying six calendar months after the final folding steps illustrated in FIGS. 6*a* and 6*b*.
Figure 7B:
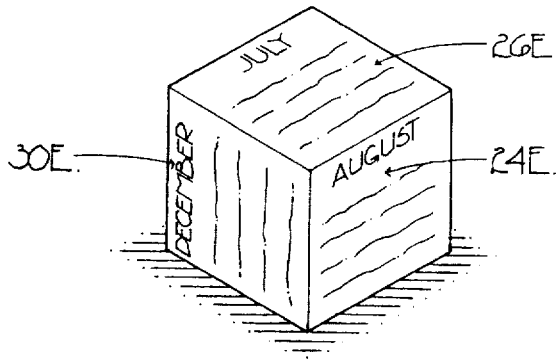

FIGS. 7*a* and 7*b* illustrate a final view and a rotated final view of the completed preferred embodiment of the folding calendar display system 10 of the present invention displaying the last six months and days and dates of a calendar year.

Figure 7C:
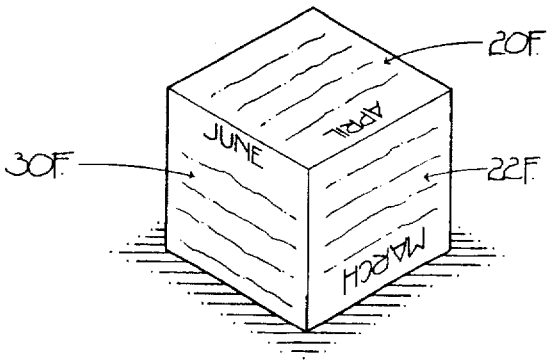
FIGS. 7*c* and 7*d* are two isometric views of the completed first embodiment of the reversible three dimensional geometric cubic parallelepiped assembly of the present invention displaying six calendar months after repeating the folding steps illustrated in FIGS. 3–6*b*, but in the reverse direction.
Figure 7D:
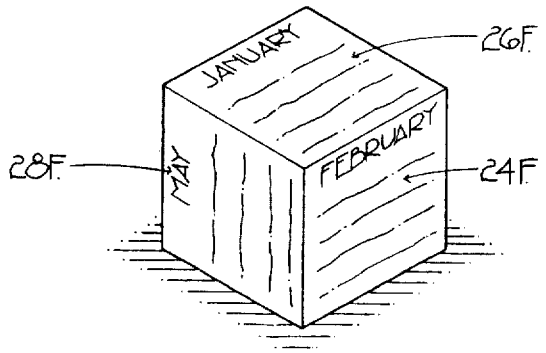

To display the second side face of the display system 10, the display system 10 is first unfolded and oriented, as in FIG. 1*b*. Then the folding steps of FIGS. 2–6*b* are all repeated except that the tabs and the side wall panels are all folding in the opposite direction. FIGS. 7*c* and 7*d* are the two final views of the completed preferred embodiment of the folding calendar display system 10 of the present invention displaying the first six months and days and dates of a calendar year.

While tab portions 21, 23 and 25 have been described as interacting with slots 37 and 39, and wall 20 to close and maintain the cubic parallelepiped shape of the folding display assembly, it will be appreciated that any type of fastening mechanism for use in securing the display system together is within the scope of the present invention and could include, any other equivalent appropriate art known fastening means, including for example, but not limited to adhesive, adhesive tabs, hook and loop fasteners, snaps or the like.

SECOND EMBODIMENT

Figure 8A:
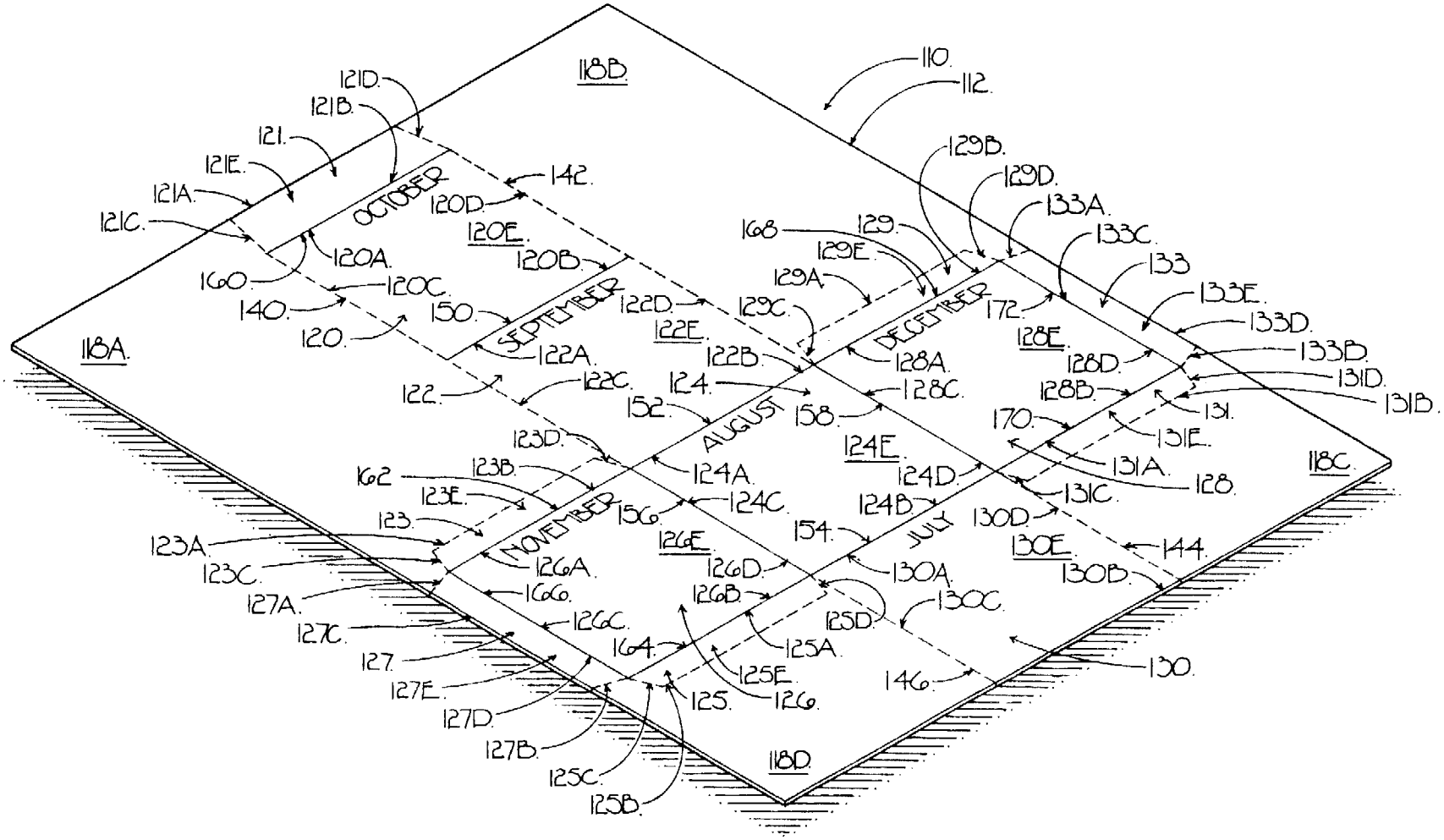
FIG. 8*a* is an isometric front view of one side of a second embodiment of a flat sheet blank of the present invention prior to the removal of excess border materials and folding it into a reversible three dimensional rectangular parallelepiped display calendar assembly.
Figure 8B:
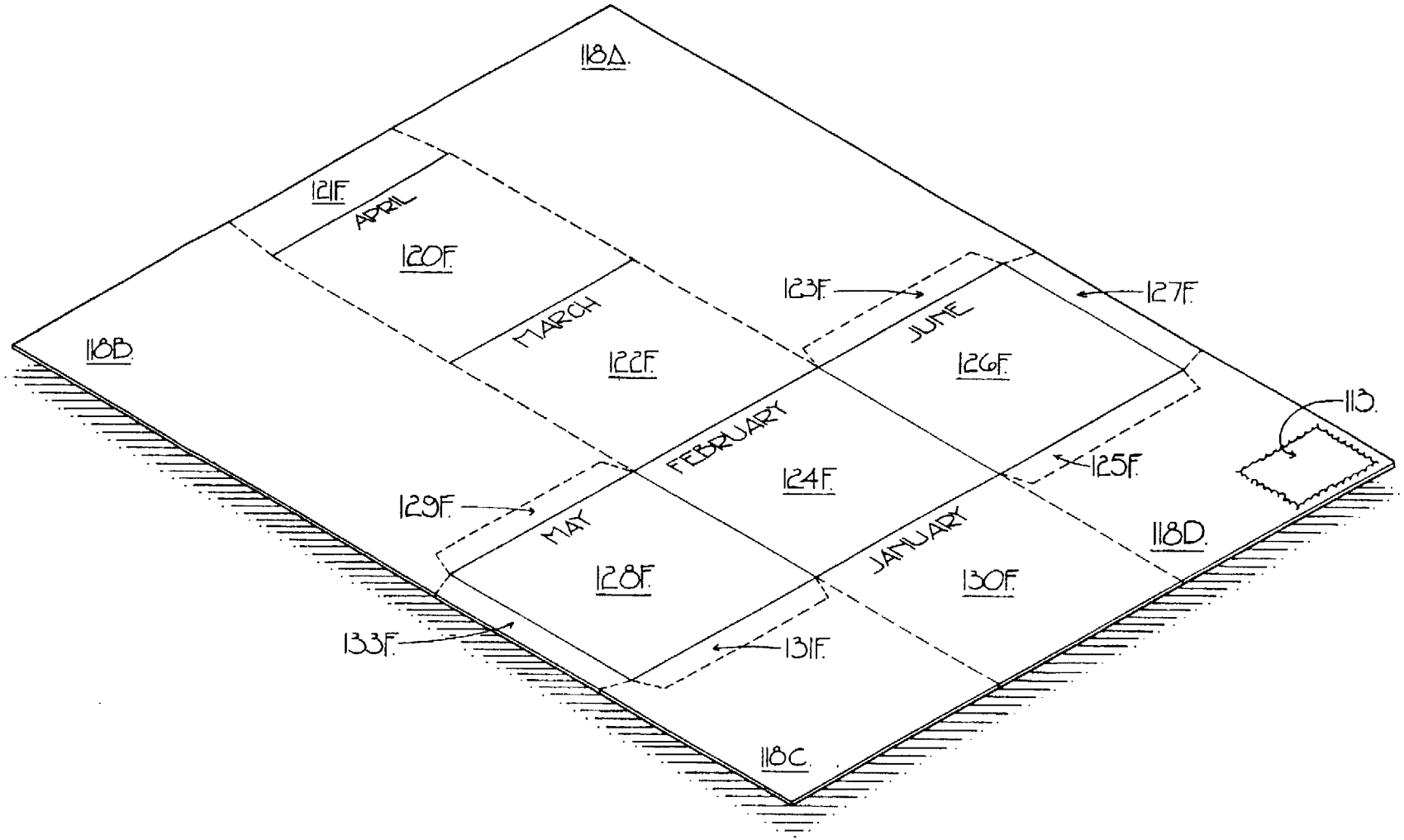
FIG. 8*b* is an isometric back view of the second side of a second embodiment of a flat sheet blank of the present invention illustrating placement of postage for use of the system when mailing and prior to the removal of excess border materials and folding it into a reversible three dimensional rectangular parallelepiped display calendar assembly.

Referring to FIGS. 8*a* and 8*b*, a second embodiment of the display sheet blank system 110 of the present invention includes a plurality of removable border materials 118A, 118B, 118C and 118D, six side wall panels 120, 122, 124, 126, 128 and 130 and a plurality of tab portions 121, 123, 125, 127, 129 and 131, 133. The entire display sheet blank 112, including the side wall panels 120, 122, 124, 126, 128 and 130 is preferably assembled from a single piece of material. As in the first embodiment, the single piece assemblage of the folding calendar display system 110 of the second embodiment reduces material waste by eliminating the need for additional material.

In the second embodiment illustrated by FIGS. 8*a* and 8*b*, the side wall panels 120, 122, 124, 126, 128 and 130 are substantially square in shape. The side wall panel 120 includes a plurality of side wall edges 120A, 120B, 120C and 120D and a first side face 120E. The side wall panel 120 also includes a second side face 120F as is illustrated in FIG. 8*b*. Referring again to FIG. 8*a*, the panel edge 120A is substantially opposite and parallel to the panel edge 120B and the panel edge 120C is substantially opposite and parallel to the panel edge 120D.

The side wall panel 122 includes a plurality of side wall edges 122A, 122B, 122C and 122D and a first side face 122E. The side wall panel 122 also includes a second side face 122F as is illustrated in FIG. 8*b*. Referring again to FIG. 8*a*, the panel edge 122A is substantially opposite and parallel to the panel edge 122B and the panel edge 122C is substantially opposite and parallel to the panel edge 122D.

The side wall panel 124 includes a plurality of side wall edges 124A, 124B, 124C and 124D and a first side face 124E. The side wall panel 124 also includes a second side face 124F as is illustrated in FIG. 8*b*. Referring again to FIG. 8*a*, the panel edge 124A is substantially opposite and parallel to the panel edge 124B and the panel edge 124C is substantially opposite and parallel to the panel edge 124D.

The side wall panel 126 includes a plurality of side wall edges 126A, 126B, 126C and 126D and a first side face 126E. The side wall panel 126 also includes a second side face 126F as is illustrated in FIG. 8*b*. Referring back to FIG.

8*a*, the panel edge 126A is substantially opposite and parallel to the panel edge 126B and the panel edge 126C is substantially opposite and parallel to the panel edge 126D.

The side wall panel 128 includes a plurality of side wall edges 128A, 128B, 128C and 128D and a first side face 128E. The side wall panel 128 also includes a second side face 128F as is illustrated in FIG. 8*b*. Referring again to FIG. 8*a*, the panel edge 128A is substantially opposite and parallel to the panel edge 128B and the panel edge 128C is substantially opposite and parallel to the panel edge 128D.

The side wall panel 130 includes a plurality of side wall edges 130A, 130B, 130C and 130D and a first side face 130E. The side wall panel 130 also includes a second side face 130F as is illustrated in FIG. 8*b*. Referring again to FIG. 8*a*, the panel edge 130A is substantially opposite and parallel to the panel edge 130B and the panel edge 130C is substantially opposite and parallel to the panel edge 130D.

Since the side panels 120, 122, 124, 126, 128, 130 of the second embodiment of the present invention are square, it follows that each of the side edges 120A, 120B, 120C, 120D, 122A, 122B, 122C, 122D, 124A, 124B, 124C, 124D, 126A, 126B, 126C, 126D, 128A, 128B, 128C, 128D, 130A, 130B, 130C and 130D are substantially equal in length to each other. Please note that side panels which are not substantially square are within the teaching of the present invention as will be seen in an embodiment of the present invention described below.

Tab portions 121, 123, 125, 127, 129, 131 and 133 are foldably connected to the corresponding adjacent side wall panels. The tab portion 121 includes a plurality of tab edges 121A, 121B, 121C and 121D and a first side face 121E. The tab portion 121 also includes a second side face 121F as is illustrated in FIG. 7*b*. Referring again to FIG. 7*a*, the tab edge 121A is substantially opposite and parallel to the tab edge 121B and the tab edge 121C is substantially opposite to the tab edge 121D. The tab edges 121C and 121D are at substantial acute angles to the tab edge 121B and additionally are angled toward each other. Such angling allows easier assemblage of the folding calendar display system 110 of the present invention as described further below.

The tab portion 23 includes a plurality of tab edges 123A, 123B, 123C and 123D and a first side face 123E. The tab portion 123 also includes a second side face 123F as is illustrated in FIG. 8*b*. Referring again to FIG. 8*a*, the tab edge 123A is substantially opposite and parallel to the tab edge 123B and the tab edge 123C is substantially opposite to the tab edge 123D. The tab edges 123C and 123D are at substantial acute angles to the tab edge 123B and are additionally angled toward each other.

The tab portion 125 includes a plurality of tab edges 125A, 125B, 125C and 125D and a first side face 125E. The tab portion 125 also includes a second side face 125F as is illustrated in FIG. 8*b*. Referring again to FIG. 8*a*, the tab edge 125A is substantially opposite and parallel to the tab edge 125B and the tab edge 125C is substantially opposite to the tab edge 125D. The tab edges 125C and 125D are at substantial acute angles to the tab edge 125A and are additionally angled toward each other.

The tab portion 127 includes a plurality of tab edges 127A, 127B, 127C and 127D and a first side face 127E. The tab portion 127 also includes a second side face 127F as is illustrated in FIG. 8*b*. Referring again to FIG. 8*a*, the tab edge 127A is substantially opposite to the tab edge 127B and the tab edge 127C is substantially opposite and parallel to the tab edge 127D. The tab edges 127A, 127B are at substantial acute angle to the tab edge 127D and are additionally angled toward each other.

The tab portion 129 includes a plurality of tab edges 129A, 129B, 129C and 129D and a first side face 129E. The tab portion 129 also includes a second side face 129F as is illustrated in FIG. 8*b*. Referring again to FIG. 8*a*, the tab edge 129A is substantially opposite and parallel to the tab edge 129B and the tab edge 129C is substantially opposite to the tab edge 129D. The tab edges 129C and 129D are at substantial acute angles to the tab edge 129B and are additionally angled toward each other.

The tab portion 131 includes a plurality of tab edges 131A, 131B, 131C and 131D and a first side face 131E. The tab portion 131 also includes a second side face 131F as is illustrated in FIG. 8*b*. Referring again to FIG. 8*a*, the tab edge 131A is substantially opposite and parallel to the tab edge 131B and the tab edge 131C is substantially opposite to the tab edge 131D. Furthermore, the tab edges 131C and 131D are at substantial acute angles to the tab edge 131B and are additionally angled toward each other.

The tab portion 133 includes a plurality of tab edges 133A, 133B, 133C and 133D and a first side face 133E. The tab portion 133 also includes a second side face 133F as is illustrated in FIG. 8*b*. Referring again to FIG. 8*a*, the tab edge 133A is substantially opposite to the tab edge 133B and the tab edge 133C is substantially opposite and parallel to the tab edge 133D. The tab edges 133A, 133B are at substantial acute angles to the tab edge 133C and are additionally angled toward each other.

The border materials 118A, 118B, 118C and 118D are positioned substantially around the tab portions 121, 123, 125, 127, 129, 131, 133 and the side wall panels 120, 122, 124, 126, 128, 130. The border material 118A is removably connected to the tab portions 121, 123, 127 and the side wall panels 120, 122 along the tab and panel edges 120C, 121C, 122C, 123A, 123C, 123D, 127A by a score line 140. The border material 118B is removably connected to the tab portions 121, 129, 133 and the side wall panels 120, 122 along the tab and panel edges 120D, 121D, 122D, 129A, 129C, 129D, 133A by a score line 142. The border material 118C is removably connected to the tab portions 131, 133 and the side wall panel 130 along the tab and panel edges 130D, 131B, 131C, 131D, 133B by a score line 144. Finally, the border material 118D is removably connected to the tab portions 125, 127 and the side wall panel 130 along the tab and panel edges 125B, 125C, 125D, 127B, 130C by a score line 146. The score lines 140, 142, 144, 146 provide for easy removal of the border materials 118A, 118B, 118C and 118D to begin the folding process to transform a mailable postcard configuration, including a portion to receive postage 113, to a folded cubic rectangular parallelepiped displaying a calendar system 110.

To form a rectangular parallelepiped display system according to the second embodiment of FIGS. 8*a* and 8*b* of the present invention, the removable material 118A, 118B, 118C and 118D are removably connected substantially about three sides of the display sheet blank 112. The material 118A is removably connected to support panels 120, 122 and tab 123 along the panel edges 120C and 122C and tab 123, respectively, along a score line. The material 118B is removably connected to the side wall panels 120, 122 and tab 129 along the panel edges 120D, 122D and 129, respectively, along a score line. The material 118C is removably connected to the side wall panel 130 along the panel edges 130D and tab 131, respectively, along a score line. Finally, the material 118D is removably connected to the side wall panels 130 and tab 125 along the panel edges 130C along a score line. The score lines allow for easy removal of the border material to begin the folding process.

The side wall panels preferably are foldably connected to each adjacent side wall panel. First, the panel 120 is foldably connected to the panel 122 along the panel edge 120B and the panel edge 122A forming a fold line 150. Second, the panel 122 is foldably connected to the panel 124 along the panel edge 122B and the panel edge 124A forming a fold line 152. Third, the panel 124 is foldably connected to the panel 126 along the panel edge 124C and the panel edge 126D forming a fold line 156. Fourth, the panel 124 is foldably connected to the panel 128 along the panel edge 124D and the panel edge 128C forming a fold line 158. Finally, the panel 124 is also foldably connected to the panel 130 along the panel edge 124B and the panel edge 130A forming a fold line 154.

The tab portions 121, 123, 125, 127, 129, 131, 133 are preferably foldably connected to the corresponding adjacent side wall panel. First, the tab portion 121 is foldably connected by a fold line 160 to the panel 120 along the tab edge 121B and the panel edge 120A. Second, the tab portion 123 is foldably connected by a fold line 162 to the panel 126 along the tab edge 123B and the panel edge 126A. Third, the tab portion 125 is foldably connected by a fold line 164 to the panel 126 along the tab edge 125A and the panel edge 126B. Fourth, the tab portion 127 is foldably connected by a fold line 166 to the panel 126 along the tab edge 127D and the panel edge 126C. Fifth, the tab portion 129 is foldably connected by a fold line 168 to the panel 128 along the tab edge 129B and the panel edge 128A. Sixth, the tab portion 131 is foldably connected by a fold line 170 to the panel 128 along the tab edge 131A and the panel edge 128B. Finally, the tab portion 133 is foldably connected by a fold line 172 to the panel 128 along the tab edge 133C and the panel edge 128D.

To form sheet blank 110 into a rectangular parallelepiped, for example in the form of a cubic rectangular parallelepiped folding calendar display system, according again to the second embodiment of the present invention, first, the border materials 118A, 118B, 118C and 118D, which are removably connected about the display sheet blank 112 as described above, is separated from the side wall panels and the tab portions along the score lines 140, 142, 144 and 146 between the border materials and the various tab portions and side panels. Once disconnected, the border material is discarded or recycled.

Then, the tab portion 121 is folded upwardly with respect to the side wall 120 toward the first side face 120E of the side wall panel 120. Next, the tab portions 123, 125 and 127, as shown in FIG. 8*a*, are folded upwardly with respect to the side wall panel 126 toward the first side face 126E of the side wall panel 126. The tab portions 129, 131 and 133, as shown in FIG. 8*a*, are folded upwardly with respect to the side wall 128 toward the first side face 128E of the side wall 128.

While not illustrated, to complete the system 110, the side wall panel 120 is folded upwardly along the fold line 150 toward the first side face 122E of the side wall panel 122. Then, the side wall panel 122 is folded upwardly along the fold line 152 toward the first side face 124E of the side wall panel 124. Next, the side wall panel 130 is folded upwardly along the fold line 154 toward the first side face 124E of the side wall panel 124 and tab 121. Finally, the side wall panels 126 and 128 are folded upwardly toward the first side face 124E of the side wall 124. The tab portions 123 and 129 are positioned under the side wall panel 122 such that the second side face 123F, 129F of the tab portions 123 and 129 rest against the first side face 122E of the side wall panel 122. Additionally, the tab portions 125 and 131 are positioned under the side wall panel 130 such that the second side face 125F and 131F rest against the first side face 130E of the side wall panel 130. Furthermore, the tab portions 127 and 133 are positioned under the side wall panel 120 such that the second side face 127F and 133F rest against the first side face 120E of the side wall panel 120.

The tabs and side wall panels work together to maintain the cubic rectangular parallelepiped shape of the folding calendar display assembly 110 and to keep the folding calendar display assembly from unfolding. To display the second side face of the display system 110, the display system 110 is unfolded and the folding steps are repeated, except that the tabs and the side wall panels are folding in the opposite direction. Such arrangement results in a display system which forms a substantially cube-like rectangular parallelepiped shape, as illustrated in FIGS. 7*a*–7*d*.

THIRD EMBODIMENT

Figure 9A:
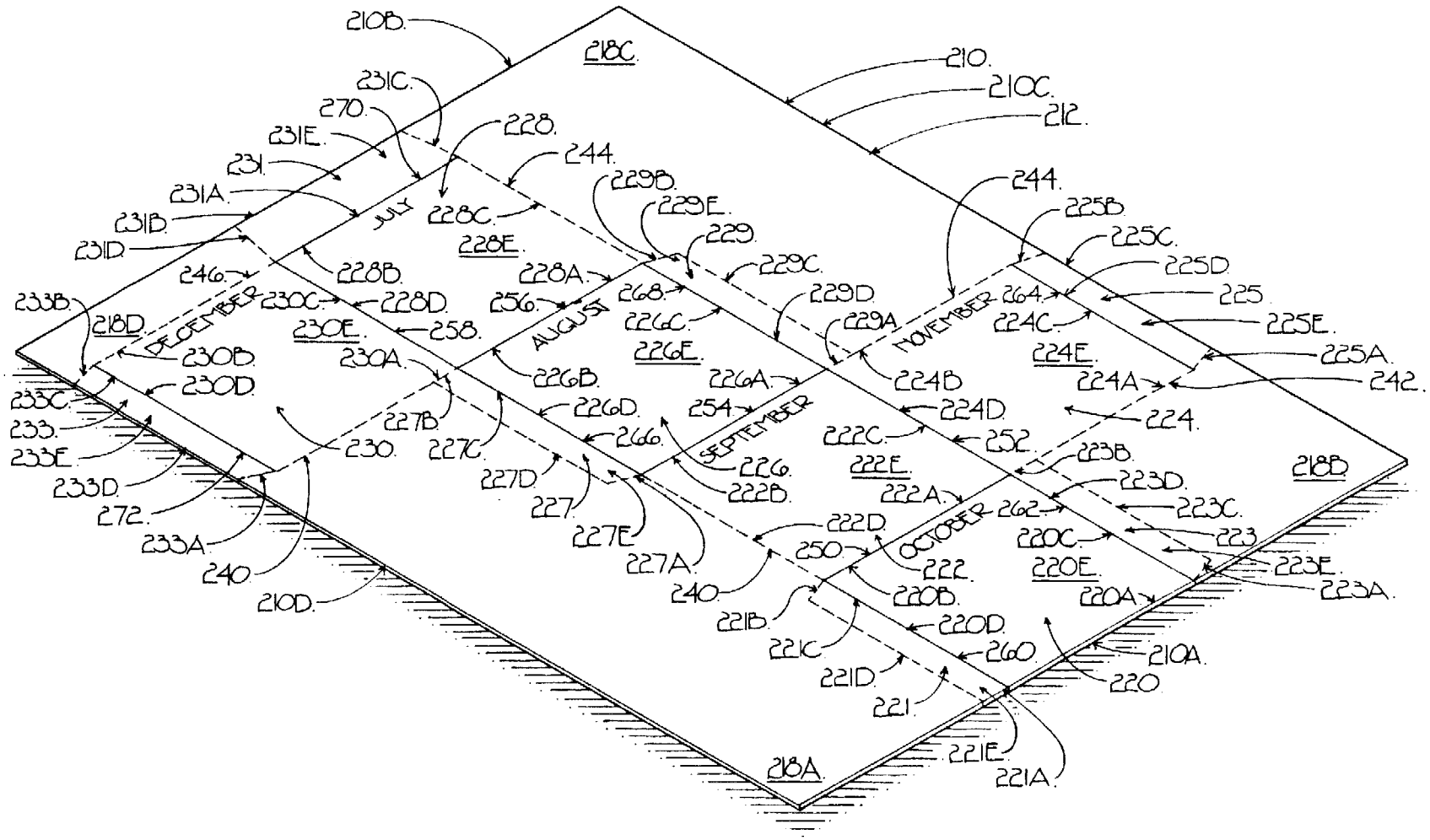
FIG. 9*a* is an isometric front view of one side of a third embodiment of a flat sheet blank of the present invention prior to the removal of excess border materials and folding it into a reversible three dimensional rectangular parallelepiped display calendar assembly.
Figure 9B:
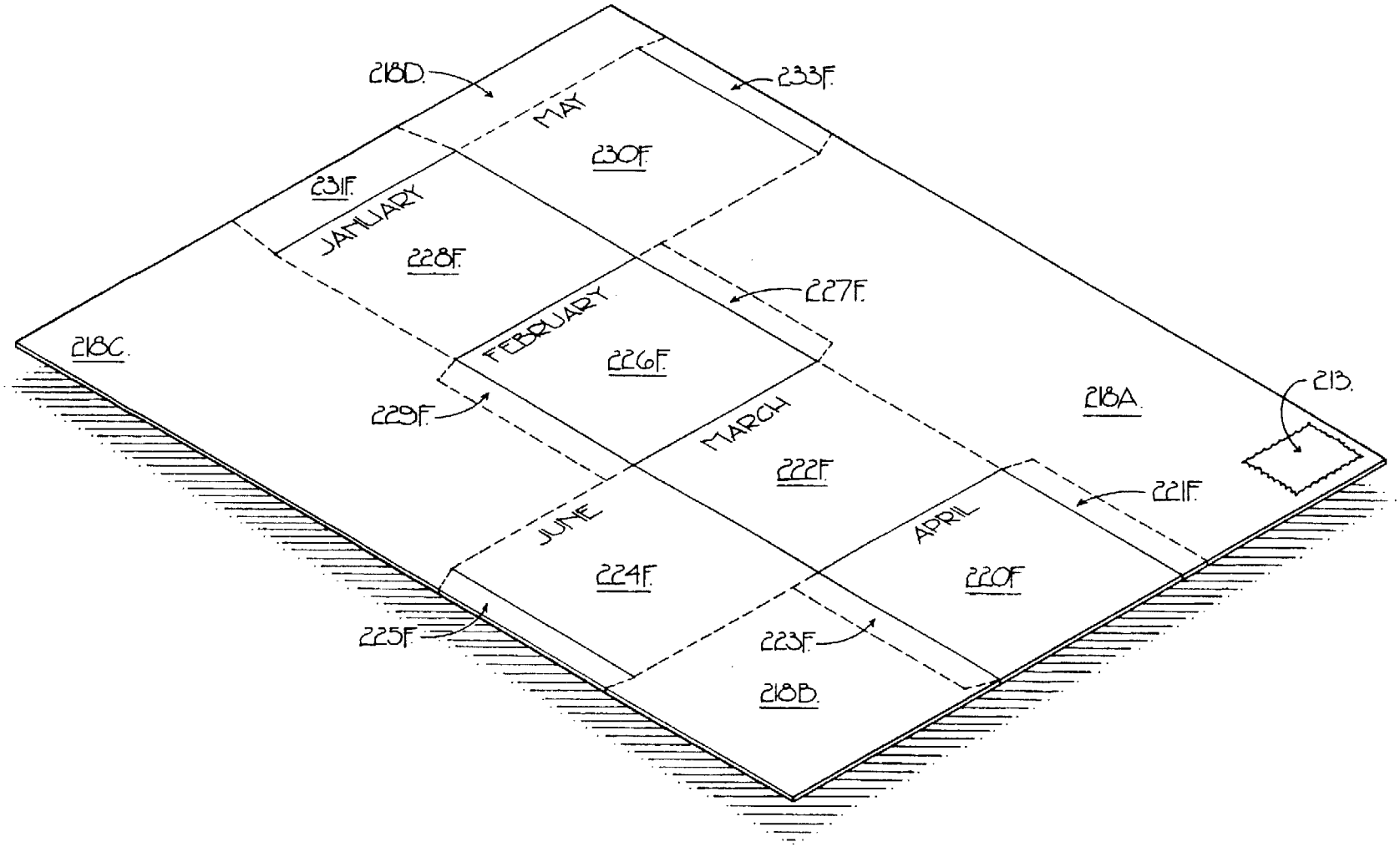
FIG. 9*b* is an isometric back view of the second side of a third embodiment of a flat sheet blank of the present invention illustrating placement of postage for use of the system when mailing and prior to the removal of excess border materials and folding it into a reversible three dimensional rectangular parallelepiped display calendar assembly.

Referring now to FIGS. 9*a* and 9*b*, a third embodiment of a display sheet blank system 210 of the present invention includes a sheet blank 212 having a plurality of removable edges 218A, 218B, 218C and 218D, six side wall panels 220, 222, 224, 226, 228 and 230, and a plurality of tab portions, 221, 223, 225, 227, 229, 231 and 233. The entire display sheet blank 212 including the side wall panels 220, 222, 224, 226, 228 and 230 is preferably assembled from a single piece of material having perimeter edges 210A, 210B, 210C and 210D. The perimeter edge 210A is substantially parallel to the perimeter edge 210B and the perimeter edge 210C is substantially parallel to perimeter edge 210D. Furthermore, perimeter edges 210A and 210B are substantially perpendicular to the perimeter edges 210C and 210D.

In the third embodiment illustrated by FIGS. 9*a* and 9*b*, the side wall panels 220, 222, 224, 226, 228 and 230 are substantially square in shape. Referring now to FIG. 9*a*, the side wall panel 220 includes a plurality of side wall edges 220A, 220B, 220C and 220D and a first side face 220E. The side wall panel 220 also includes a second side face 220F as is illustrated in FIG. 9*b*. Referring again to FIG. 9*a*, the panel edge 220A is substantially opposite and parallel to the panel edge 220B and the panel edge 220C is substantially opposite and parallel to the panel edge 220D.

The side wall panel 222 includes a plurality of side wall edges 222A, 222B, 222C and 222D and a first side face 222E. The side wall panel 222 also includes a second side face 222F as is illustrated in FIG. 9*b*. Referring again to FIG. 9*a*, the panel edge 222A is substantially opposite and parallel to the panel edge 222B and the panel edge 222C is substantially opposite and parallel to the panel edge 222D.

The side wall panel 224 includes a plurality of side wall edges 224A, 224B, 224C and 224D and a first side face 224E. The side wall panel 224 also includes a second side face 224F as is illustrated in FIG. 9*b*. Referring again to FIG. 9*a*, the panel edge 224A is substantially opposite and parallel to the panel edge 224B and the panel edge 224C is substantially opposite and parallel to the panel edge 224D.

The side wall panel 226 includes a plurality of side wall edges 226A, 226B, 226C and 226D and a first side face 226E. The side wall panel 226 also includes a second side face 226F as is illustrated in FIG. 9*b*. Referring back to FIG. 9*a*, the panel edge 226A is substantially opposite and parallel to the panel edge 226B and the panel edge 226C is substantially opposite and parallel to the panel edge 226D.

The side wall panel 228 includes a plurality of side wall edges 228A, 228B, 228C and 228D and a first side face 228E. The side wall panel 228 also includes a second side face 228F as is illustrated in FIG. 9*b*. Referring again to FIG. 9*a*, the panel edge 228A is substantially opposite and parallel to the panel edge 228B and the panel edge 228C is substantially opposite and parallel to the panel edge 228D.

The side wall panel 230 includes a plurality of side wall edges 230A, 230B, 230C and 230D and a first side face 230E. The side wall panel 230 also includes a second side face 230F as is illustrated in FIG. 9*b*. Referring again to FIG. 9*a*, the panel edge 230A is substantially opposite and parallel to the panel edge 230B and the panel edge 230C is substantially opposite and parallel to the panel edge 230D.

Since the side wall panels 220, 222, 224, 226, 228 and 230 are square, it follows that each of the side edges 220A, 220B, 220C, 220D, 222A, 222B, 222C, 222D, 224A, 224B, 224C, 224D, 226A, 226B, 226C, 226D, 228A, 228B, 228C, 228D, 230A, 230B, 230C and 230D are substantially equal to each other. Preferably, the tab portions 221, 223, 225, 227, 229, 231 and 233 are foldably connected to the adjacent side wall panels. The tab portion 221 includes a plurality of tab edges 221A, 221B, 221C and 221D and a first side face 221E. The tab portion 221 also includes a second side face 221F as is illustrated in FIG. 9*b*. Referring again to FIG. 9*a*, the tab edge 221A is substantially opposite to the tab edge 221B and the tab edge 221C is substantially opposite and parallel to the tab edge 221D. The tab edge 221A is substantially perpendicular to the tab edges 221C and 221D and the tab edge 221B is angled with respect to and toward the tab edge 221A to allow easier assemblage of the folding calendar display system 210 of the present invention as described further below.

The tab portion 223 includes a plurality of tab edges 223A, 223B, 223C and 223D and a first side face 223E. The tab portion 223 also includes a second side face 223F as is illustrated in FIG. 9*b*. Referring again to FIG. 9*a*, the tab edge 223A is substantially opposite to the tab edge 223B and the tab edge 223C is substantially opposite and parallel to the tab edge 223D. The tab edge 223B is substantially perpendicular to the tab edges 223C and 223D and the tab edge 223A is angled with respect to and toward the tab edge 223B.

The tab portion 225 includes a plurality of tab edges 225A, 225B, 225C and 225D and a first side face 225E. The tab portion 225 also includes a second side face 225F as is illustrated in FIG. 9*b*. Referring again to FIG. 9*a*, the tab edge 225A is substantially opposite to the tab edge 225B and the tab edge 225C is substantially opposite and parallel to the tab edge 225D. The tab edges 225A, 225B are at substantial acute angles to the tab edge 223D and are additionally angled toward each other.

The tab portion 227 includes a plurality of tab edges 227A, 227B, 227C and 227D and a first side face 227E. The tab portion 227 also includes a second side face 227F as is illustrated in FIG. 9*b*. Referring again to FIG. 9*a*, the tab edge 227A is substantially opposite to the tab edge 227B and the tab edge 227C is substantially opposite and parallel to the tab edge 227D. The tab edge 227B is substantially perpendicular to the tab edges 227C and 227D and the tab edge 227A is angled with respect to and toward the tab edge 227B.

The tab portion 229 includes a plurality of tab edges 229A, 229B, 229C and 229D and a first side face 229E. The tab portion 229 also includes a second side face 229F as is illustrated in FIG. 9*b*. Referring again to FIG. 9*a*, the tab edge 229A is substantially opposite to the tab edge 229B and the tab edge 229C is substantially opposite and parallel to the tab edge 229D. The tab edge 229A is substantially perpendicular to the tab edges 229C and 229D and the tab edge 229B is angled with respect to and toward the tab edge 229A.

The tab portion 231 includes a plurality of tab edges 231A, 231B, 231C and 231D and a first side face 231E. The tab portion 231 also includes a second side face 231F as is illustrated in FIG. 9*b*. Referring again to FIG. 9*a*, the tab edge 231A is substantially opposite and parallel to the tab edge 231B and the tab edge 231C is substantially opposite to the tab edge 231D. Furthermore, the tab edges 231C and 231D are at substantial acute angles to the tab edge 231D and are additionally angled toward each other.

The tab portion 233 includes a plurality of tab edges 233A, 233B, 233C and 233D and a first side face 233E. The tab portion 233 also includes a second side face 233F as is illustrated in FIG. 9*b*. Referring again to FIG. 9*a*, the tab edge 23A is substantially opposite to the tab edge 233B and the tab edge 233C is substantially opposite and parallel to the tab edge 233D. The tab edges 233A, 233B are at substantial acute angles to the tab edge 233C and are additionally angled toward each other.

The border materials 218A, 218B, 218C and 218D are positioned substantially around the tab portions 221, 223 and 225, 227, 229, 231 and 233 and the side wall panels 220, 222, 224, 226, 228 and 230. The border material 218A is removably connected to the tab portions 221, 227 and 233 and the side wall panels 222 and 230 along the tab and panel edges 221D, 221B, 227A, 227D, 233A, 222D and 230A by a score line 240. The material 218B is removably connected to the tab portions 223 and 225 and the side wall panel 224 along the tab and panel edges 223A, 223C, 225A and 224A by a score line 242. The material 218C is removably connected to the tab portions 225, 229 and 231 and the side wall panels 224 and 228 along the tab and panel edges 225B, 229B, 229C, 231C, 224B and 228C by a score line 244. Finally, the material 218D is removably connected to the tab portions 231 and 233 and the side wall panel 230 along the tab and panel edges 231D, 233B and 230B by a score line 246. The score lines 240, 242, 244 and 246 provide for easy removal of the border material 218 to begin the folding process to transform the folding calendar system 210 of the present invention from a mailable postcard configuration, including a portion to receive postage 213.

The side wall panels are preferably foldably connected to each adjacent side wall panel. First, the panel 220 is foldably connected to the panel 222 along the panel edge 220B and the panel edge 222A forming a fold line 250. Second, the panel 222 is foldably connected to the panel 224 along the panel edge 222C and the panel edge 224D forming a fold line 252. Third, the panel 222 is foldably connected to the panel 226 along the panel edge 222B and the panel edge 226A forming a fold line 254. Fourth, the panel 226 is foldably connected to the panel 228 along the panel edge 226B and the panel edge 228A forming a fold line 256. Finally, the panel 228 is also foldably connected to the panel 230 along the panel edge 228D and the panel edge 230C forming a fold line 258.

The tab portions 221, 223, 225, 227, 229, 231 and 233 are preferably foldably connected to the corresponding adjacent side wall panel. First, the tab portion 221 is foldably connected by a fold line 260 to the panel 220 along the tab edge 221C and the panel edge 220D. Second, the tab portion 223 is foldably connected by a fold line 262 to the panel 220 along the tab edge 223D and the panel edge 220C. Third, the tab portion 225 is foldably connected by a fold line 264 to the panel 224 along the tab edge 225D and the panel edge 224C. Fourth, the tab portion 227 is foldably connected by a fold line 266 to the panel 226 along the tab edge 227C and the panel edge 226D. Fifth, the tab portion 229 is foldably connected by a fold line 268 to the panel 226 along the tab edge 229D and the panel edge 226C. Sixth, the tab portion 231 is foldably connected by a fold line 270 to the panel 228 along the tab edge 231A and the panel edge 228B. Finally, the tab portion 233 is foldably connected by a fold line 272 to the panel 230 along the tab edge 233C and the panel edge 230D.

To form the folding calendar display system 210 accord to the third embodiment of the present invention, first, the border material 218A, 218B, 218C and 218D, which are removably connected about the display sheet blank 212 as described above, is separated from the side wall panels and the tab portions along the score lines 240, 242, 244 and 246 between the border materials and the various tab portions and side panels. Once disconnected, the border material is discarded or recycled.

Then, the tab portions 221 and.223 are folded upwardly along the fold lines 260 and 262, respectively, toward the first side face 220E of the side wall panel 220. The side wall panel 220 is then folded upwardly along the fold line 250 toward the first side face 222E of the side wall panel 222.

Next, the tab portion 225 is folded upwardly along the fold line 264 toward the first side face 224E of the side wall panel 224. The side wall panel 224 is folded upwardly along the fold line 252 toward the first side face 222E of the side wall panel 222 until the first side face 224E of the side wall panel 224 rests against the second side face 223F of the tab portion 223.

Then, the tab portions 227 and 229 are folded upwardly along the fold lines 266 and 268, respectively, toward the first side face 226E of the side wall panel 226. The side wall panel 226 is folded upwardly along the fold line 254 toward the first side face 222E of the side wall panel 222 with the second side face 227F of the tab portion 227 and the second side face 229F of the tab portion 229 positioned under the side wall panel 224 and against the first side face 224E.

Then, the tab portion 231 is folded upwardly along the fold line 270 toward the first side face 228E of the side wall panel 228. The side wall panel 228 is folded upwardly along the fold line 256 toward the first side face 226E of the side wall 226 with the second side face 231F of the tab portion 231 positioned under the side wall panel 220 and against the first side face 220E.

The tab portion 233 is folded upwardly along the fold line 272 toward the first side face 230E of the side wall panel 230. Then, the side wall panel 230 is folded upward along the fold line 258 toward the first side face 228E of the side wall panel 228 with the second side face 233F of the tab portion 233 positioned under the first side face 222E of the side wall 222.

The tab portions 221, 223, 225, 227, 229, 231 and 232 and the side wall panels 220, 222, 224, 226, 228 and 230 cooperate together to maintain the cubic rectangular parallelepiped shape of the folding calendar display assembly 210 and to keep the folding calendar display assembly 210 from unfolding. A releasably pressure-sensitive adhesive may be applied between the second side face of the tab portions and the first side face of the side wall panels to assist in maintaining the box-like shape.

To display the second side of the folding calendar display system provided by sheet blank 210, the folded calendar display system 210 is unfolded and the folding steps are repeated except that the tab portions and the side wall panels are folded in the opposite direction.

The third preferred embodiment, as described above, has side wall panels 220, 222, 224, 226, 228 and 230 which are substantially equal in size. Such arrangement results in a display system 210 which forms a substantially cube-like rectangular parallelepiped shape, as illustrated in FIGS. *7a–7d*.

FOURTH EMBODIMENT

Figure 10A:
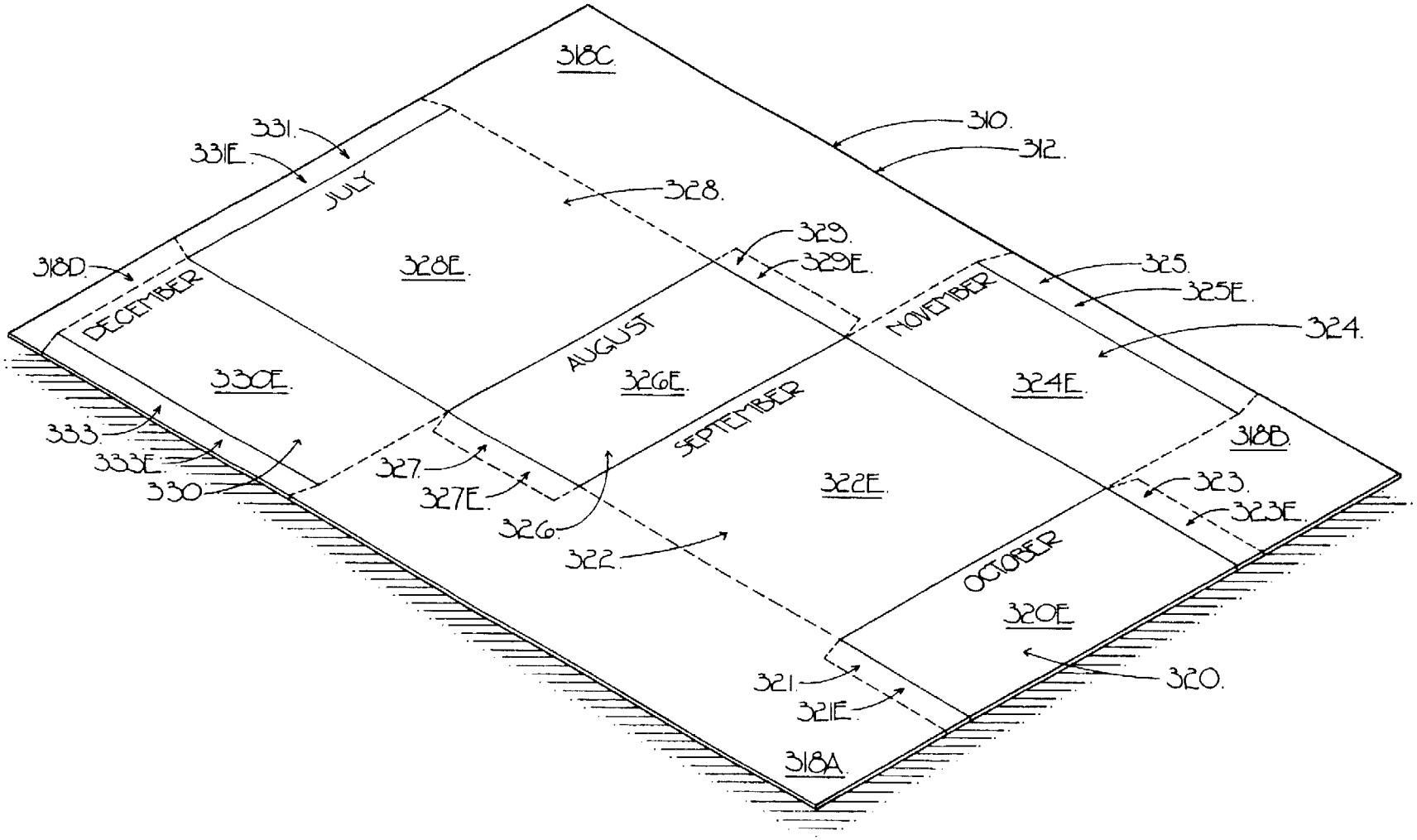
FIG. 10*a* is an isometric front view of one side of a forth embodiment of a flat sheet blank of the present invention prior to the removal of excess border materials and folding it into a reversible three dimensional rectangular parallelepiped display calendar assembly.
Figure 10B:
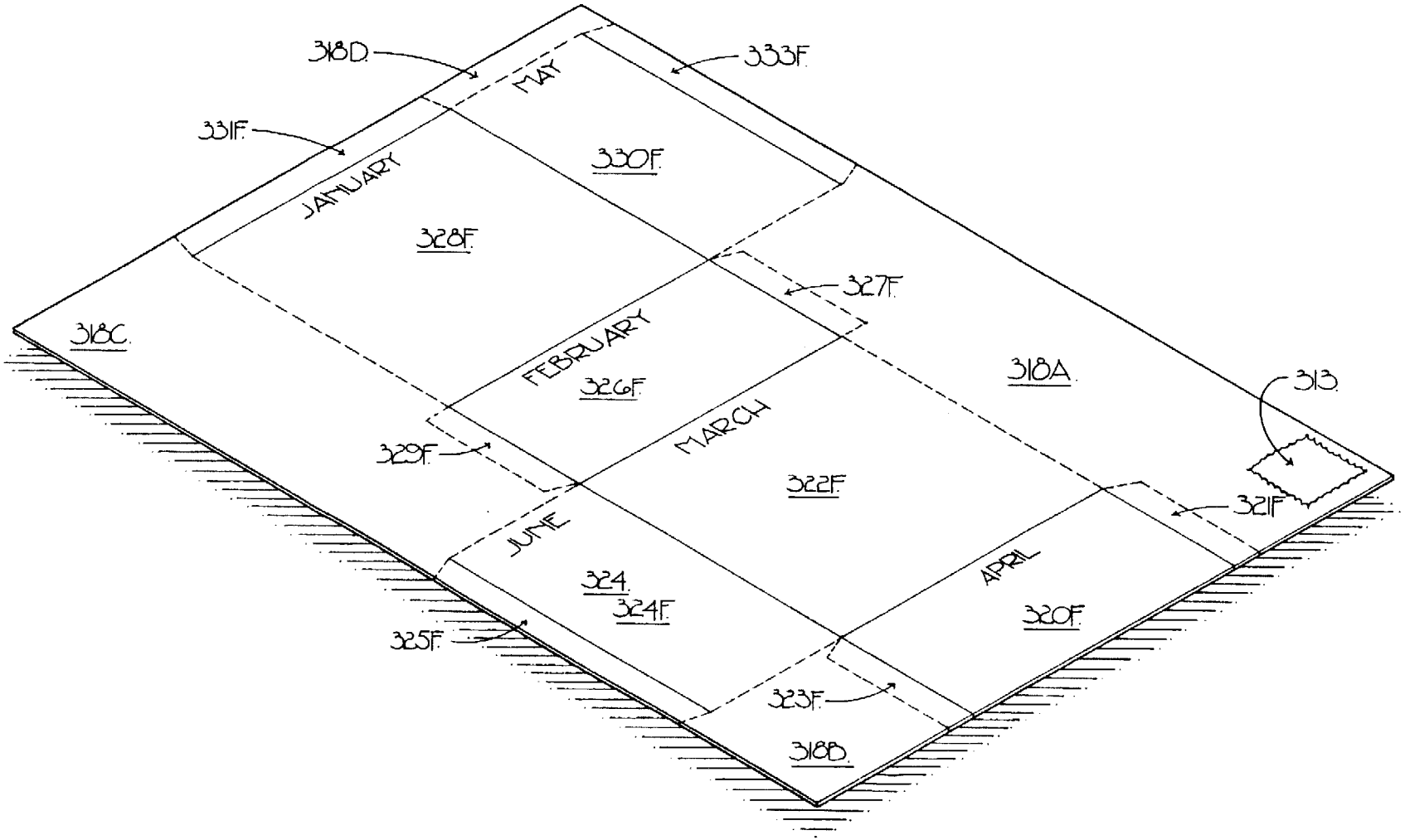
FIG. 10*b* is an isometric back view of the second side of a forth embodiment of a flat sheet blank of the present invention illustrating placement of postage for use of the system when mailing and prior to the removal of excess border materials and folding it into a reversible three dimensional rectangular parallelepiped display calendar assembly.

FIGS. 10*a* and 10*b* reveal a fourth embodiment of the folding calendar display system 310 of the present invention. The display system 310 includes a display sheet blank 312 having removable border materials 318A, 318B, 318C and 318D, side wall panels 320, 322, 324, 326, 328 and 330 and tab portions 321, 323, 325, 327, 329, 331 and 333, and including a portion to receive postage 313. The difference between the third embodiment and the fourth embodiment is the relative sizes of the side wall panels. In this fourth embodiment, the side wall panels 322 and 328 are approximately equal in size and substantially square in shape, while the side wall panels 320, 324, 326 and 330 are approximately equal in size and substantially rectangular in shape.

The fourth embodiment is folded as described with regard to the third embodiment above. The resulting display system 310 of the fourth embodiment results in a rectangular parallelepiped which is not a cube.

In all embodiments of the present invention, it should also be noted that side wall panels and support panels of the display system of the present invention may be sized and shaped such that the resultant display has various geometric shapes. The side walls are sized to receive, in addition to calendar information, other visual indicia, such as trademarks, service marks, logos, trade names, slogans, advertisements and the like. Also, as discussed above, the present invention is unique in that the unfolded display system may be sized to conform to U.S. Postal Service regulations to be mailable as a postcard, or, if outside of that size range, to be mailable as an open flat 1st class piece without an envelope with an appropriate amount of postage. It may also be mailed in an envelope, or used separately as a card, poster or any other form of flat printed material.

It is thus seen that the present invention provides a flat sheet blank in the form of a parallelogram which has a first and a second surface, each surface carrying different indicia, which flat sheet blank may be folded into a three dimensional geometric display system. Furthermore, none of the known prior art provides such a sheet blank which may be distributed or mailed without an envelope, for example as a postcard, or used as a card, poster or any other form of flat sheet carrying printed indicia on the first and second sides of the card, such as a calendar display of six months on the first side and six months on the second side. It further provides such a sheet blank which may be folded to display a first set of indicia, and then opened and refolded in the reverse direction to display a second set of indicia, for example, wherein the first set of indicia displays six months and days and dates of a calendar, and which, when opened, and refolded in the reverse direction displays the next six months and days and dates of a calendar. As a result, for example, this provides advertisers with the ability to include with their direct mail advertising a calendar, or other form of advertisement, which the recipient will display for an extended period of time. An advertiser who may provide an advertising piece in the form of a sheet which may be folded to provide an attractive three dimensional calendar display system will be able to reduce their mailing costs, while at the same time extended the period of time that the advertisement is retained, and also reducing paper consumption.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

The invention in which exclusive rights are claimed is:

1. A substantially rigid, segmented, flat sheet blank in the shape of a parallelogram which may be shaped and folded into a reversible three dimensional rectangular parallelepiped, wherein said sheet is initially comprised of:

six foldably connected side wall panels, each side wall panel being in the form of a parallelogram of a given size and shape, wherein four foldably connected side wall panels are aligned in series along a common axis, said four aligned and foldably connected side wall panels defining a pair of side edges offset from said common axis, one edge on each side of said axial series of four side wall panels, and wherein a pair of side wall panels are offset from said linear series of four side wall panels, one side wall panel offset on each side edge of said linear series of four side wall panels, each offset side wall panel foldably connected to one and only one of said side wall panels of said series of four side wall panels, and wherein further, each of the six side wall panels is a parallelogram of a given size and shape having at least one matching side wall panel parallelogram of the same size and shape separated from it by at least one intervening side wall panel, and wherein said pair of offset side wall panel parallelograms each have substantially the same size and shape; and additional material adapted to define, with said six side wall panels, a substantially flat sheet blank in the shape of a parallelogram, said additional material selected from the group consisting of support panels foldably connected to said side wall panels, excess border material connected to at least one of said side wall panels, and combinations of said support panels and said excess border material; wherein said six foldably connected side wall panels, said excess border material, if any, and said support panels, if any, define a rigid, substantially flat, segmented sheet blank in the shape of a parallelogram, said sheet having a first side having a first display surface and a second opposed side having a second display surface, and wherein further said side wall panels of said sheet and said support panels, if any, are adapted to be folded into a first three dimensional rectangular parallelepiped in which said first display surface is on the exterior of said parallelepiped, and wherein further, said first three dimensional rectangular parallelepiped may then be unfolded and refolded in the opposite direction into a second three dimensional rectangular parallelepiped in which said second display surface is on the exterior of said parallelepiped.

2. The rigid, segmented, flat sheet blank of claim 1 wherein there are support panels, and each said support panel is offset from and foldably connected to one and only one of said linear series of four side wall panels, and wherein said support panels include means for disconnection from any offset side wall panel or other offset support panel to which it may be adjacent.

3. The rigid, segmented, flat sheet blank of claim 2 wherein there are at least two said support panels, with at least one support panel on each side edge of said linear series of four side wall panels, each offset support panel foldably connected to one and only one of said side wall panels of said series of four side wall panels.

4. The rigid, segmented, flat sheet blank of claim 2 wherein there is no excess border material, and in which there are six said support panels of which three support panels are offset on each side edge of said linear series of four side wall panels, each offset support panel foldably connected at said edges to one and only one of said side wall panels of said series of four side wall panels at the locations at which there are no offset side wall panels connected to said series of four side wall panels, said side wall panels and said support panels forming a flat sheet blank substantially in the shape of a parallelogram.

5. The rigid, segmented, flat sheet blank of claim 2 wherein there are six said support panels, three support panels offset on each side edge of said linear series of four side wall panels, each offset support panel foldably connected to only one of said side wall panels of said series of four side wall panels at the locations at which there are no offset side wall panels connected to said series of four side wall panels, and wherein there is one or more tab carried by said side wall panels, and wherein said excess border material, said side wall panels, said tabs and said support panels form a flat sheet blank substantially in the shape of a parallelogram.

6. The rigid, segmented, flat sheet blank of claim 5 wherein said flat sheet blank parallelogram is rectangular in shape.

7. The rigid, segmented, flat sheet blank of claim 1 wherein said flat sheet blank parallelogram is rectangular in shape.

8. The rigid, segmented, flat sheet blank of claim 1 wherein there are no said support panels, and wherein said excess border material and said six side wall panels form a flat sheet blank substantially in the shape of a parallelogram.

9. The rigid, segmented, flat sheet blank of claim 8 wherein the substantially flat sheet blank parallelogram is rectangular in shape.

10. The rigid, segmented, flat sheet blank of claim 9 wherein each said side wall panel first side has a first display surface and each said side wall panel second side has a second display surface.

11. The rigid, segmented, flat sheet blank of claim 10 wherein both said first display surfaces and said second display surfaces carry indicia.

12. The rigid, segmented, flat sheet blank of claim 10 wherein said six side wall panel first sides each carry one of six consecutive calendar months of a calendar year on its respective first display surface and each said side wall panel second sides each carry one of the remaining six consecutive calendar months of a calendar year on its respective second display surface.

13. The rigid, segmented, flat sheet blank of claim 12 wherein each calendar month includes days and dates; wherein the sheet blank may be folded to display six consecutive months of a calendar year, and then opened and refolded in the reverse direction to display the remaining six months of a calendar year.

14. The rigid, segmented, flat sheet blank of claim 13 which is adapted and sized so that postage may be affixed to one of its surfaces so that it may be mailed without an envelope.

15. The rigid, segmented, flat sheet blank of claim 1 which is adapted and sized so that postage may be affixed to one of its surfaces so that it may be accepted for mailing without an envelope.

16. The rigid, segmented, flat sheet blank of claim 1 in which said sheet is composed of material selected from paper, poster sheet material, fiber sheet, card sheet, cardboard, and foldable plastic.

17. The rigid, segmented, flat sheet blank of claim 1 in which said sheet carries fastening means to secure said sheet after it has been shaped and folded into a reversible three dimensional rectangular parallelepiped.

18. A folding calendar display system, the system comprising:

a flat calendar display sheet having at least six side wall panels, with each side wall panel having a first side and a second side for a total of twelve sides, and with one of the twelve calendar months displayed on one of said twelve side wall panels, said flat display sheet being adapted, sized and configured to be mailable as a rectangular postcard in an unfolded configuration, each of the side wall panels foldably connected to at least one adjacent side wall panel, whereby the display surface folds into a substantially parallelepiped calendar display system.

19. The display system of claim 18 which further includes a plurality of support panels foldably connected to an adjacent side wall panel.

20. The display system of claim 19 and further including fastening means for maintaining the display system in its three dimensional configuration.

21. A folding calendar display assembly, the assembly including:

a plurality of side wall panels and a border material removably connected to at least one of said side wall panels, said side wall panels being foldably connected to a least one adjacent side wall panel;

a perimeter defined by at least one of the side wall panels and said border material; whereby the perimeter defines a substantially rectangular card, and wherein further, when said border material is removed from the side wall panels, said side wall panels are foldable into a box-like assembly for displaying information.

22. The process of forming a rectangular parallelepiped calendar display system from a substantially rigid, segmented, flat sheet blank in the shape of a rectangle wherein said sheet is initially comprised of six foldably connected side wall panels, each side wall panel being in the form of a parallelogram of a given size and in the shape of a square or rectangle, and wherein four foldably connected side wall panels are aligned in series along a common axis, said four aligned and foldably connected side wall panels defining a pair of side edges offset from said common axis, one edge on each side of said axial series of four side wall panels, and wherein a pair of side wall panels are offset from said axial series of four side wall panels, one side wall panel offset on each side edge of said linear series of four side wall panels, each offset side wall panel foldably connected to one and only one of said side wall panels of said series of four side wall panels, and wherein further, each of said six side wall panels is a parallelogram of a given size and shape having at least one matching side wall panel parallelogram of the same size and shape separated from it by at least one intervening side wall panel, and wherein said pair of offset side wall panel parallelograms each have substantially the same size and shape; and additional material adapted to define, with said six side wall panels, a substantially flat sheet blank in the shape of a rectangle, said additional material selected from the group consisting of support panels foldably connected to said side wall panels and including means for disconnection between each offset side wall panel and each support panel from each next adjacent offset side wall panel and from each next adjacent offset support panel, excess border material removably connected to at least one of said side wall panels, and combinations of said support panels and said excess border material; wherein said six foldably connected side wall panels, said excess border material, if any, and said support panels, if any, define a substantially flat, segmented sheet blank in the shape of a rectangle, said sheet having a first side having a first display surface and a second opposed side having a second display surface so that each said side wall panel first side has a first display surface and each said side wall panel second side has a second display surface, and wherein further said six side wall panel first sides each carry one of six consecutive calendar months of a calendar year on its respective first display surface and each said side wall panel second sides each carry one of the remaining six consecutive calendar months of a calendar year on its respective second display surface, and wherein further said side wall panels of said sheet and said support panels, if any, are adapted to be folded into a first three dimensional rectangular parallelepiped in which said first display surface is on the exterior of said parallelepiped, and wherein further, said first three dimensional rectangular parallelepiped may then be unfolded and refolded in the opposite direction into a second three dimensional rectangular parallelepiped in which said second display surface is on the exterior of said parallelepiped, including the steps of:

removing excess border material, if any;

using said means for disconnection to separate each offset side wall panel and each support panel from each next adjacent offset side wall panel and from each next adjacent offset support panel;

starting at one end of said axial series of four side wall panels, folding any attached side wall panels or support panels towards said end axial wall panel;

starting at said same one end of said axial series of four side wall panels, folding said end side wall panel and any attached, folded, side wall panels or support panels towards the next adjacent axial wall panel;

sequentially folding any attached side wall panels or support panels towards the next adjacent axial wall panel; and then sequentially folding said next side wall panel and any attached, folded, side wall panels or support panels towards the next adjacent axial wall panel, and continuing this folding process until a rectangular parallelepiped having all six side wall panels as the surfaces of said rectangular parallelepiped and displaying on each of said six side wall panels one of six consecutive months of a calendar year.

* * * * *